US007503772B2

(12) United States Patent
Kobori et al.

(10) Patent No.: US 7,503,772 B2
(45) Date of Patent: Mar. 17, 2009

(54) SOCKET FOR SEMICONDUCTOR DEVICE

(75) Inventors: Eiji Kobori, Tokyo (JP); Shuuji Kunioka, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 11/878,712

(22) Filed: Jul. 26, 2007

(65) Prior Publication Data

US 2008/0026603 A1 Jan. 31, 2008

(30) Foreign Application Priority Data

Jul. 28, 2006 (JP) ..... 2006-206849

(51) Int. Cl.
*H01R 12/00* (2006.01)

(52) U.S. Cl. ..... 439/73

(58) Field of Classification Search ..... 439/73, 439/331, 70, 71

See application file for complete search history.

(56) References Cited

U.S. PATENT DOCUMENTS

| | | | | |
|---|---|---|---|---|
| 4,420,205 | A | 12/1983 | Kirkman | |
| 4,739,257 | A | 4/1988 | Jenson et al. | |
| 5,073,117 | A | 12/1991 | Malhi et al. | |
| 5,147,213 | A | 9/1992 | Funk et al. | |
| 5,281,160 | A | 1/1994 | Walkup et al. | |
| 5,807,104 | A * | 9/1998 | Ikeya et al. | 439/73 |
| 6,280,219 | B1 * | 8/2001 | Sano et al. | 439/268 |
| 6,283,780 | B1 * | 9/2001 | Yamamoto et al. | 439/266 |
| 6,709,279 | B2 * | 3/2004 | Uratsuji | 439/71 |
| 6,860,742 | B2 * | 3/2005 | Shimada | 439/70 |
| 6,955,543 | B2 * | 10/2005 | Messina et al. | 439/73 |
| 7,196,907 | B2 * | 3/2007 | Zheng | 361/760 |
| 7,331,811 | B2 * | 2/2008 | Yang et al. | 439/331 |
| 7,335,030 | B2 * | 2/2008 | Kunioka et al. | 439/73 |
| 2002/0086562 | A1 * | 7/2002 | Uratsuji | 439/71 |
| 2002/0182901 | A1 * | 12/2002 | Koopman et al. | 439/71 |
| 2004/0023526 | A1 * | 2/2004 | Shimada | 439/70 |
| 2004/0048502 | A1 * | 3/2004 | Ohashi | 439/73 |
| 2004/0137767 | A1 * | 7/2004 | Suzuki et al. | 439/73 |
| 2004/0229500 | A1 * | 11/2004 | Ichihara et al. | 439/526 |
| 2005/0037640 | A1 * | 2/2005 | Messina et al. | 439/71 |
| 2005/0037641 | A1 * | 2/2005 | Chen et al. | 439/71 |
| 2006/0205247 | A1 * | 9/2006 | Kunioka et al. | 439/73 |
| 2007/0004261 | A1 * | 1/2007 | Hayakawa | 439/331 |
| 2007/0020983 | A1 * | 1/2007 | Yang et al. | 439/331 |
| 2007/0049066 | A1 * | 3/2007 | Ju | 439/73 |

(Continued)

FOREIGN PATENT DOCUMENTS

| | | |
|---|---|---|
| JP | 06-045040 | 2/1994 |

(Continued)

OTHER PUBLICATIONS

Office Action dated Jun. 24, 2008 issued in corresponding Japanese Patent Application No. 2006-206849.

*Primary Examiner*—Ross N Gushi
(74) *Attorney, Agent, or Firm*—Finnegan, Henderson, Farabow, Garrett & Dunner, LLP

(57) ABSTRACT

The probe pin cartridge is held in the cartridge accommodating region of the frame body when the slider members are in the locked state, and detachable from the cartridge accommodating region when the slider members are in the unlocked state by the operation of the operating buttons.

7 Claims, 27 Drawing Sheets

U.S. PATENT DOCUMENTS

| | | | | |
|---|---|---|---|---|
| 2007/0259543 | A1* | 11/2007 | Hsieh | 439/73 |
| 2008/0020623 | A1* | 1/2008 | Wooden | 439/331 |
| 2008/0113528 | A1* | 5/2008 | Kunioka et al. | 439/73 |

FOREIGN PATENT DOCUMENTS

| | | |
|---|---|---|
| JP | 07-245088 | 9/1995 |
| JP | 10-041035 | 2/1998 |
| JP | 2001-051016 | 2/2001 |
| JP | 2002-243794 | 8/2002 |
| JP | 2002-260801 | 9/2002 |
| JP | 2003-243117 | 8/2003 |
| JP | 2004-71240 | 3/2004 |
| JP | 2005-227289 | 8/2005 |
| JP | 2006-032034 | 2/2006 |
| JP | 2006-286613 | 10/2006 |
| JP | 2007-122913 | 5/2007 |
| JP | 2007-141614 | 6/2007 |

* cited by examiner

SOCKET FOR SEMICONDUCTOR DEVICE

This application claims the benefit of Japanese Patent Application No. 2006-206849, filed Jul. 28, 2006, which is hereby incorporated by reference herein in its entirety.

BACKGROUND OF THE INVENTION

1. Field of the Invention

The present invention relates to a socket for a semiconductor device provided with a detachable cartridge for contact terminals.

2. Description of the Related Art

Semiconductor devices to be mounted to electronic equipments or others are subjected to various tests before being mounted, for the purpose of removing their latent defects. Such tests are carried out via a socket on which the semiconductor device to be tested is detachably mounted.

The socket for the semiconductor device used for such tests are generally called as an IC socket and arranged on a printed wiring board as disclosed, for example, in Japanese Patent Laid-Open No. 2004-071240. Such a printed wiring board has an input/output section for inputting a predetermined test voltage to the semiconductor device and outputting detected abnormal signals representing a short-circuit or others therefrom.

At that time, a socket body of the IC socket is fastened to the circuit board by screws and nuts through a plurality of holes provided in the wiring board.

Such an IC socket has a group of contact terminals in the interior thereof for electrically connecting terminals of the semiconductor device to the input/output section of the printed wiring board. The group of the contact terminals is exchanged to a fresh one if the stable electric connection becomes difficult due to any trouble or the end of the life of the contact terminal. To facilitate such the exchanging operation of contact terminals, as disclosed, for example, in Japanese Patent Laid-Open No. 2002-243794, a socket block is proposed, having a portion for accommodating the semiconductor device, and a plurality of contact pins. The socket block is disposed in the interior of the socket body of a predetermined type by locking means to be easily detachable therefrom.

SUMMARY OF THE INVENTION

When it is required that the above-mentioned socket block is disposed in other types of IC sockets, such as a clam shell type or a pressure-amount adjustable type, the design of the socket block must be made engineering changes to a great extent in accordance with the types thereof.

By taking such a problem into account, an object of the present invention is to provide a socket for a semiconductor device detachably provided with a contact terminal cartridge capable of being shared among various types of the semiconductor device sockets while being simply detachable/attachable thereto.

To achieve the above-mentioned object, the socket for the semiconductor device according to the present invention comprises a contact terminal cartridge having a substrate for holding a group of contact terminals electrically connected to terminals of a semiconductor device; a frame body fixed onto said substrate, having an accommodating region for detachably accommodating said contact terminal cartridge; and a locking/unlocking mechanism comprising slider members slidably disposed in said frame body, for holding said contact terminal cartridge accommodated in said accommodating region in a locked state or an unlocked state, wherein the upper surfaces of said slider members are located at a position lower than the topmost ends of contact terminals forming said group of contact terminals of said contact terminal cartridge.

As apparent from the above-mentioned description, in the socket for the semiconductor device according to the present invention, the upper surface of the slider member is located at a position lower than the topmost end of the contact terminal in the group of the contact terminals of the terminal cartridge. Accordingly, it is possible to provide a structure wherein the semiconductor device mounting region is disposed on the upper surface of the slider member while pressing the contacts of the group of contact terminals on the semiconductor device mounting region side. Thus, it is possible to commonly use the contact terminal cartridge to various types of the socket for the semiconductor device. In addition, by providing the locking/unlocking mechanism capable of maintaining the contact terminal cartridge in the locked or unlocked state, the contact terminal cartridge is easily attachable or detachable relative to the accommodating region of the frame body.

Further features of the present invention will become apparent from the following description of exemplary embodiments (with reference to the attached drawings).

DESCRIPTION OF THE EMBODIMENTS

Figure 7:
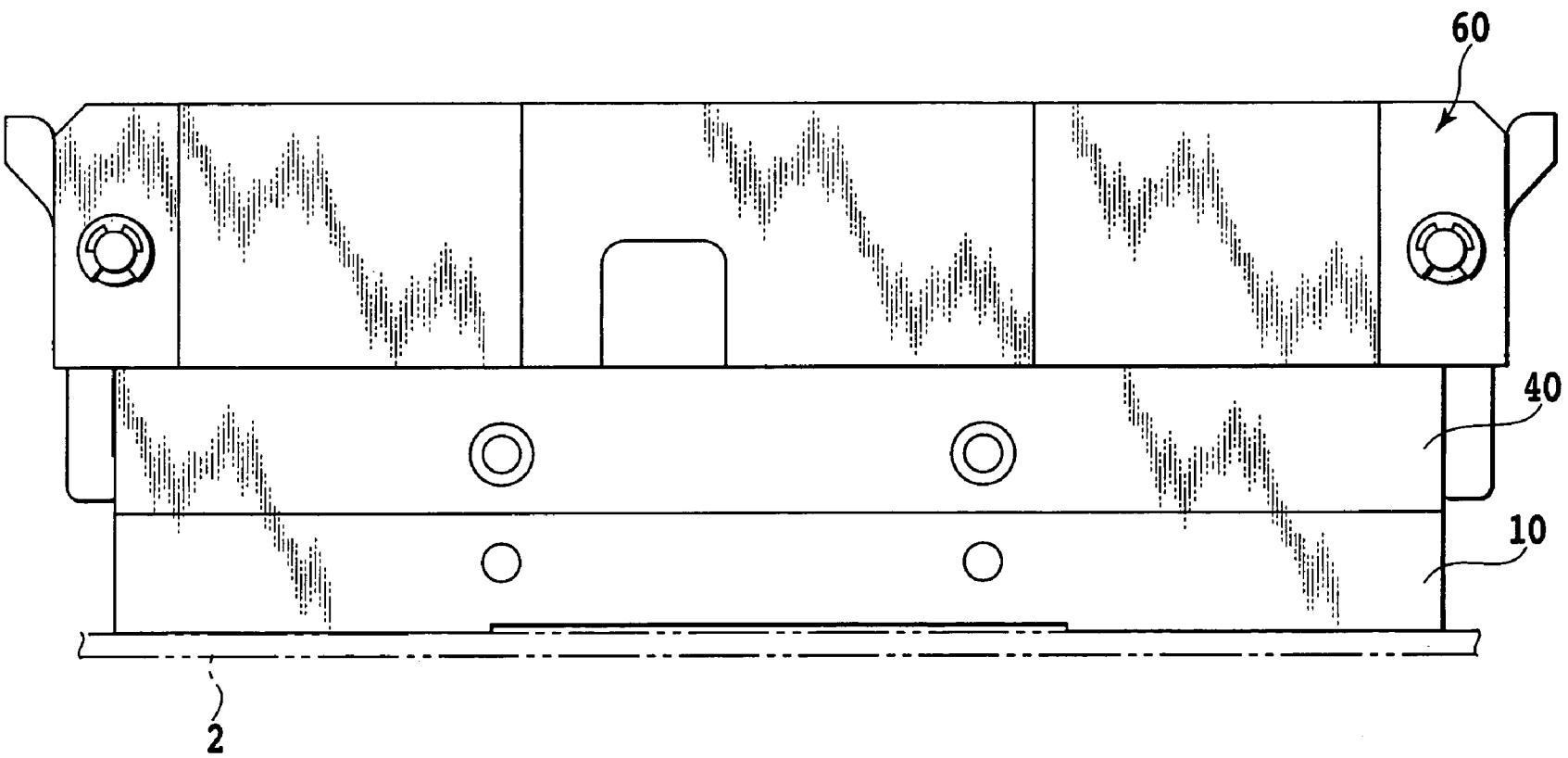
FIG. 7 is a front view of the embodiment shown in FIG. 6.

FIG. 7 illustrates an appearance of one embodiment of a socket for a semiconductor device according to the present invention.

The embodiment shown in FIG. 7 is a so-called lid form socket of a manual type.

In this socket, as shown in FIG. 7, a positioning pedestal unit 41 used as a semiconductor device mounting region and a lid portion 60 formed as a pressing mechanism member are detachably disposed on the upper surface of a frame body 10 described later positioned on a printed wiring board 2.

Figure 8:
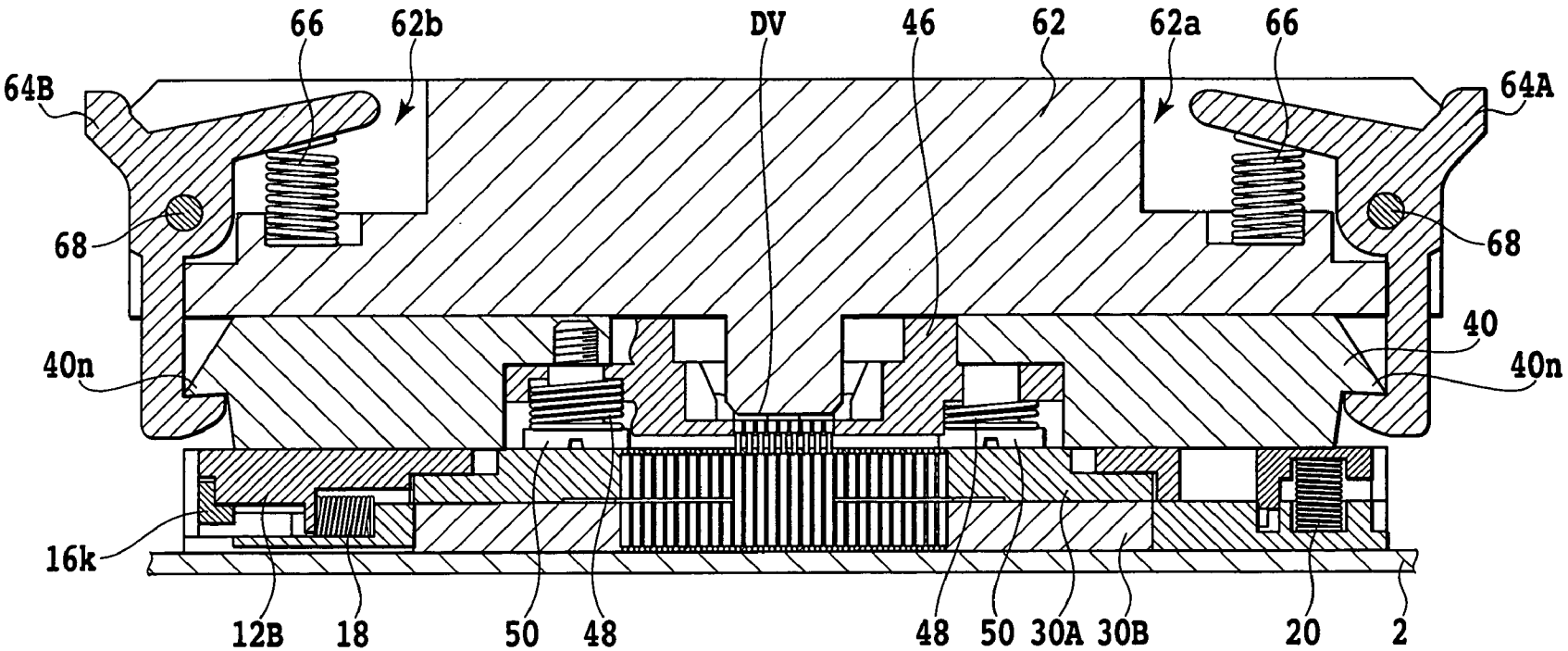
FIG. 8 is a sectional view of the embodiment shown in FIG. 7.
Figure 13:
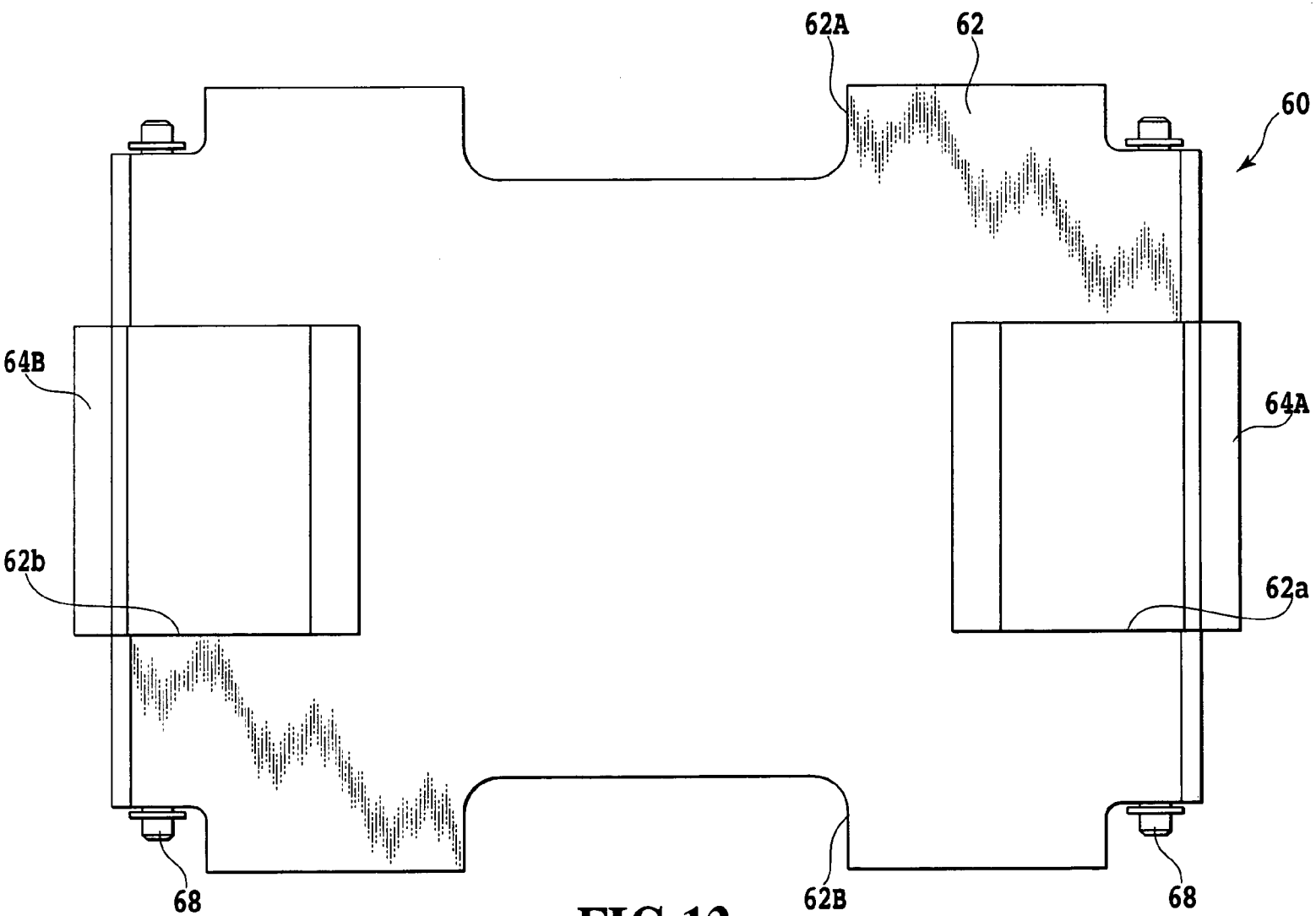
FIG. 13 is a plan view of a lid portion used in the embodiment of the socket for the semiconductor device according to the present invention.

As shown in FIGS. 8 and 13, the lid portion 60 is placed on the upper surface of a body part of the positioning pedestal unit 41 described later, and presses an electrode surface of a mounted semiconductor device DV (see FIGS. 8 and 20) onto probe pins 32*ai* of a probe pin cartridge 30. The semiconductor device DV is of a generally square shape, such as a BGA (ball grid array) type or a LGA (land grid array) type, having an electrode surface on which are formed a plurality of electrodes in a matrix.

Figure 6:
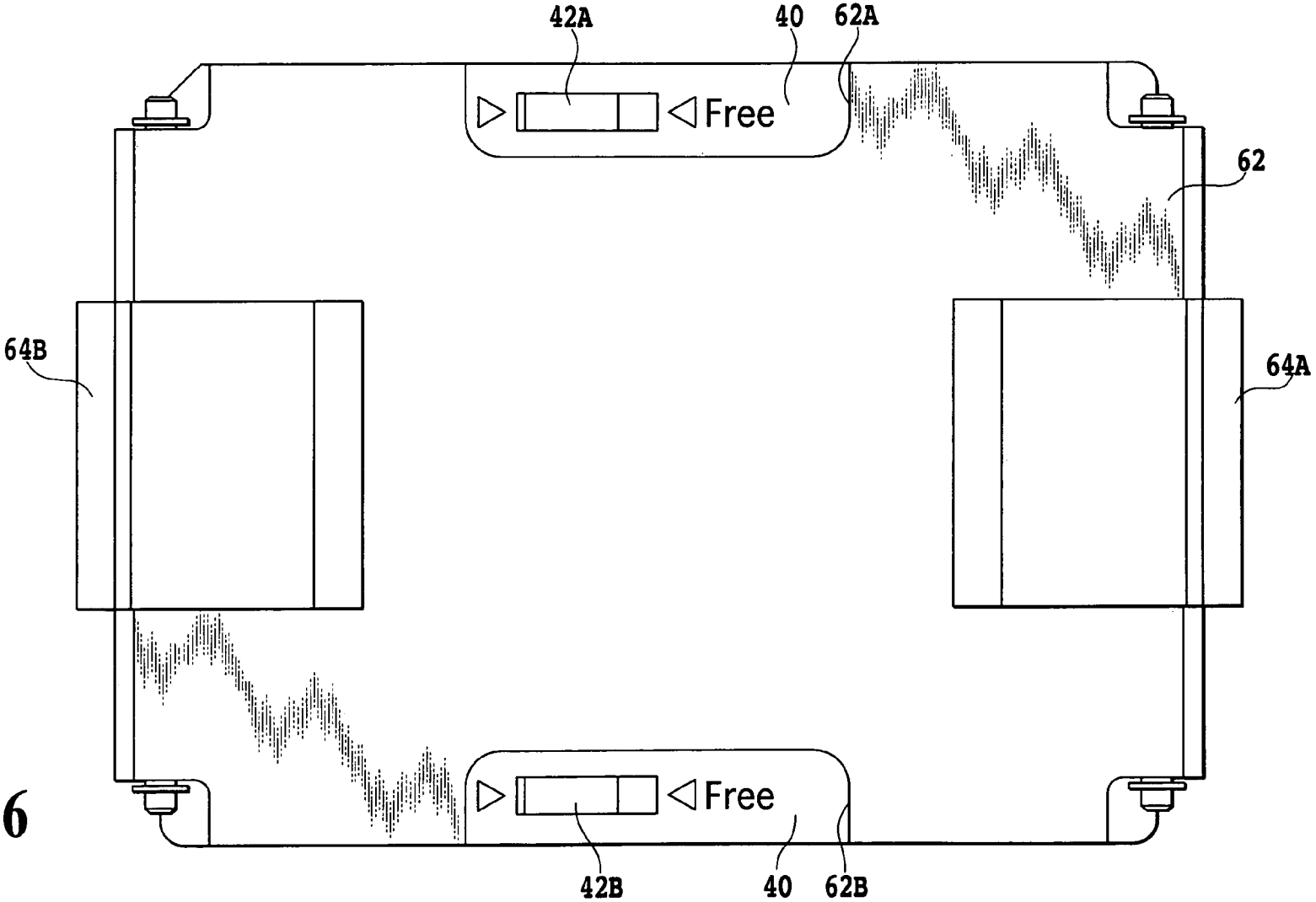
FIG. 6 is a plan view of the appearance of the embodiment of a socket for a semiconductor device according to the present invention.
Figure 9:
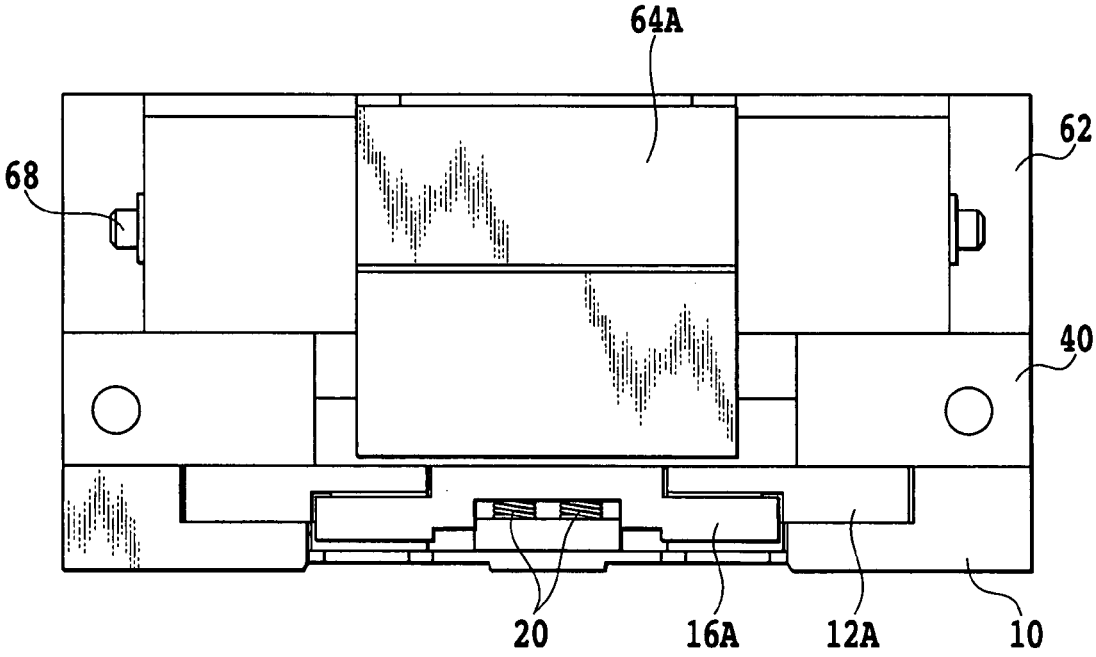
FIG. 9 is a side view of the embodiment shown in FIG. 7.
Figure 14:
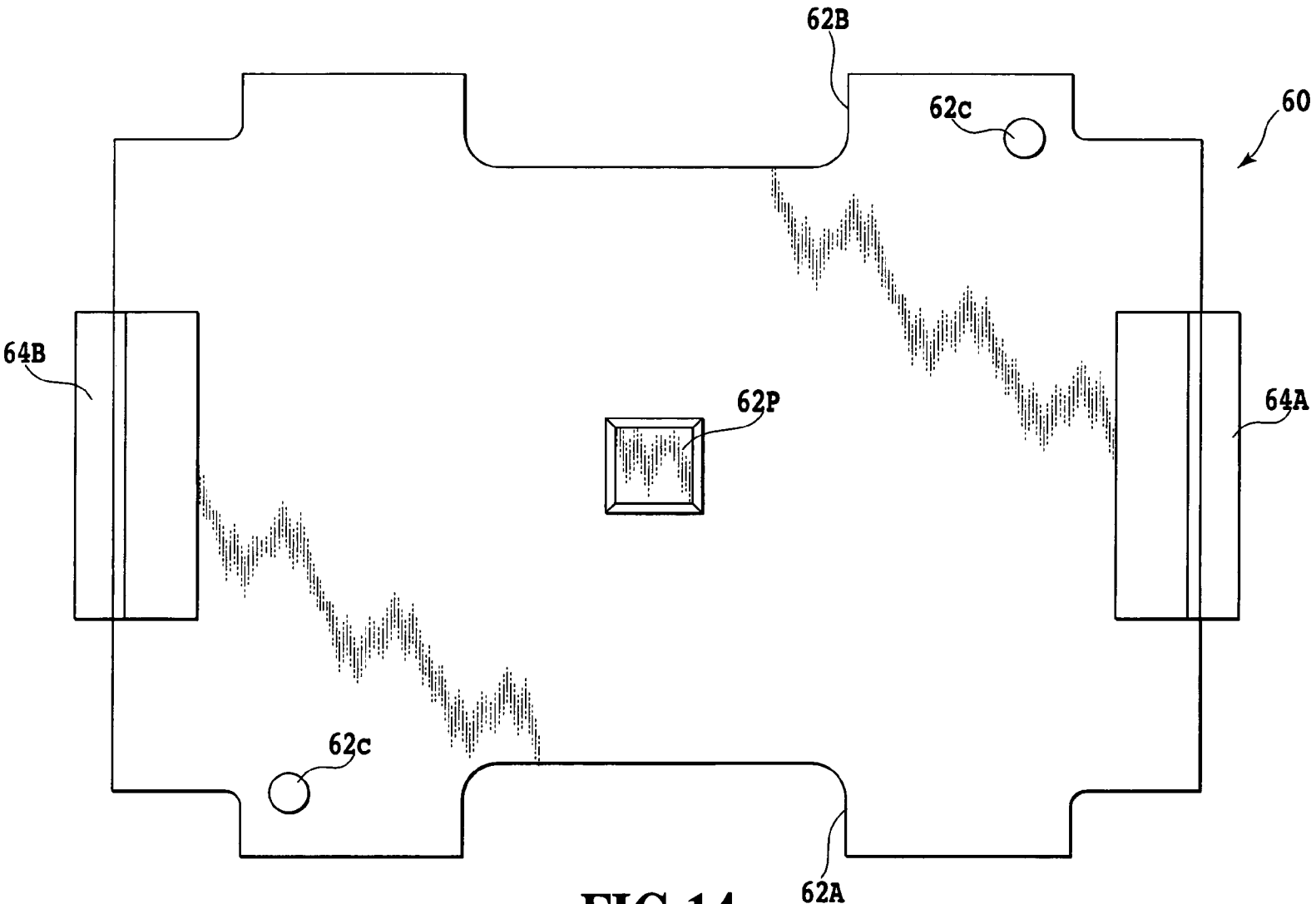
FIG. 14 is a bottom view of the embodiment shown in FIG. 13.
Figure 15:
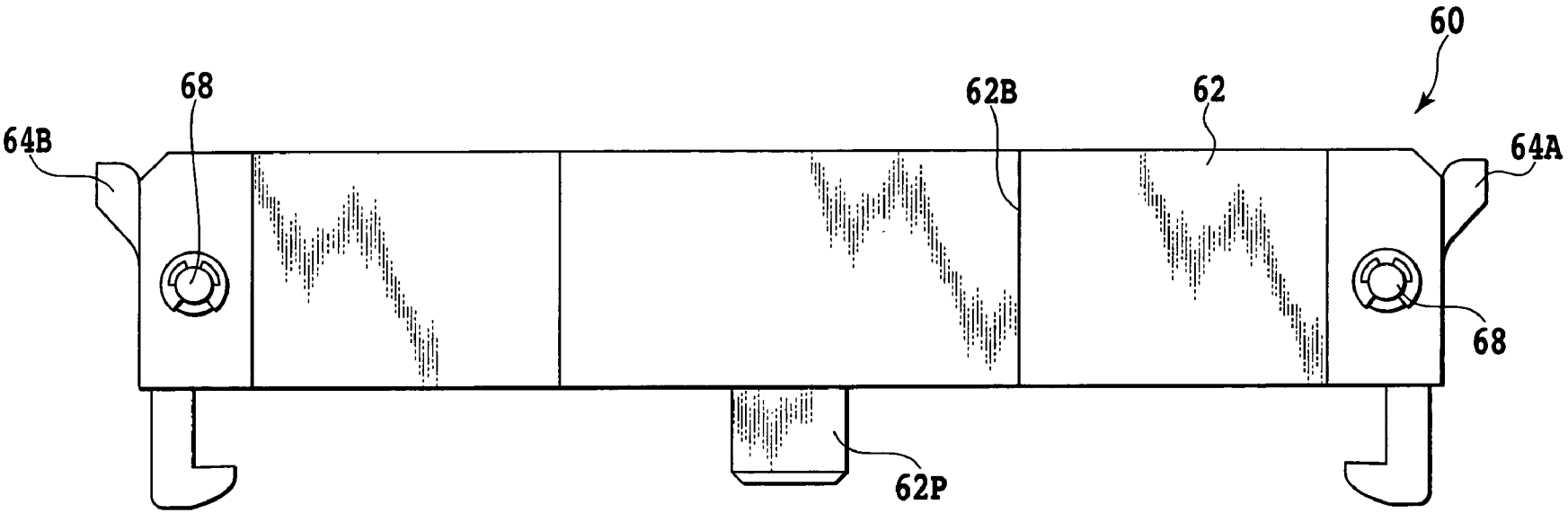
FIG. 15 is a front view of the embodiment shown in FIG. 13.
Figure 16:
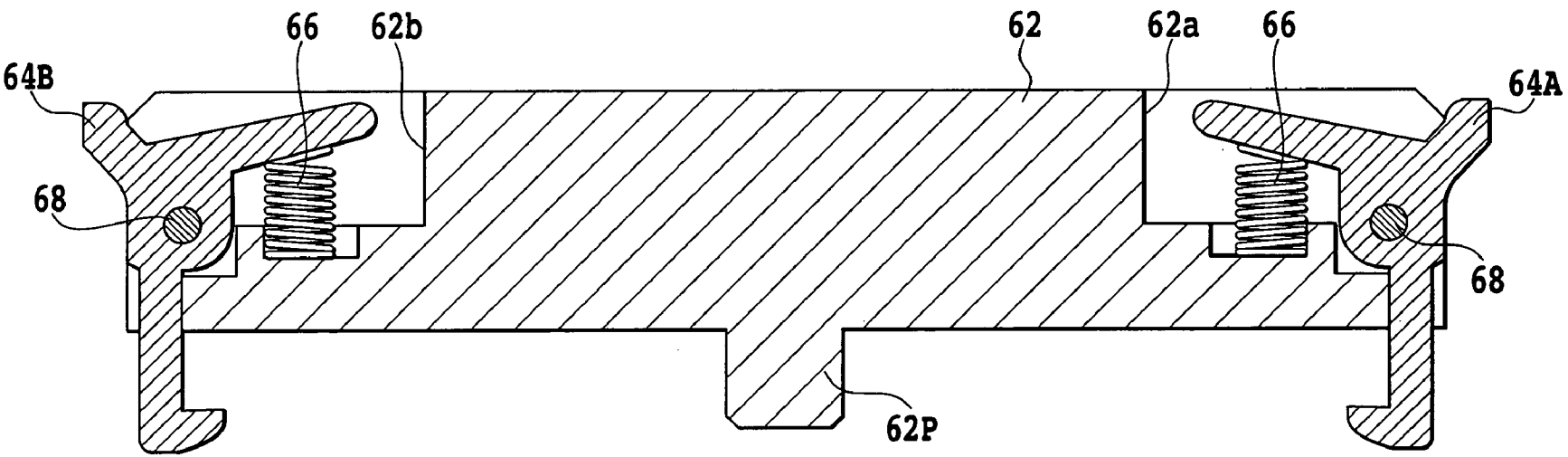
FIG. 16 is a sectional view of the embodiment shown in FIG. 13.

In recesses 62*a* and 62*b* formed with an edge cutting away on the opposite sides of a body portion 62 of the lid portion 60, latch members 64A and 64B for holding or releasing the lid portion 60 relative to the positioning pedestal unit 41 described later are respectively rotational moveably provided. The latch members 64A, 64B are rotational moveably supported by shafts 68, as shown in FIG. 13, provided at opposite ends of the lid portion 60 to pass through the recesses 62*a* and 62*b*, respectively. As shown in FIGS. 8 and 9, the latch members 64A and 64B respectively have, at one ends thereof, a projection selectively engageable with a nib 40*n* of the positioning pedestal unit 41. As shown in FIGS. 8 and 16, another end of the respective latch member 64A, 64B is biased by a coil spring 66 provided between the former and the bottom surface of the respective recess 62*a*, 62*b* in the direction so that the projection is engaged with the nib 40*n*. As shown in FIG. 6, notch sections 62A and 62B are formed on the remaining opposite sides of the lid portion 60, and operation handles 42P of the lever members 42A and 42B described later are inserted therein. As shown in FIG. 14, on the lower surface of the body portion 62 of the lid portion 60 opposed to the positioning pedestal unit 41, a pressing section 62P is formed in a central area thereof. As shown in FIG. 15, the pressing section 62P of a generally cubic form is projected out of the lower surface of the body portion 62 of the lid portion 60 by a predetermined height. Also, a pair of bottomed holes 62*c* are formed on the lower surface in a point symmetrical manner so that the pressing section 62P becomes a center of symmetry while making a predetermined angle to a center axis of the lid portion 60. In this hole 62*c*, one end of a positioning pin 44 described later is fitted.

Figure 5:
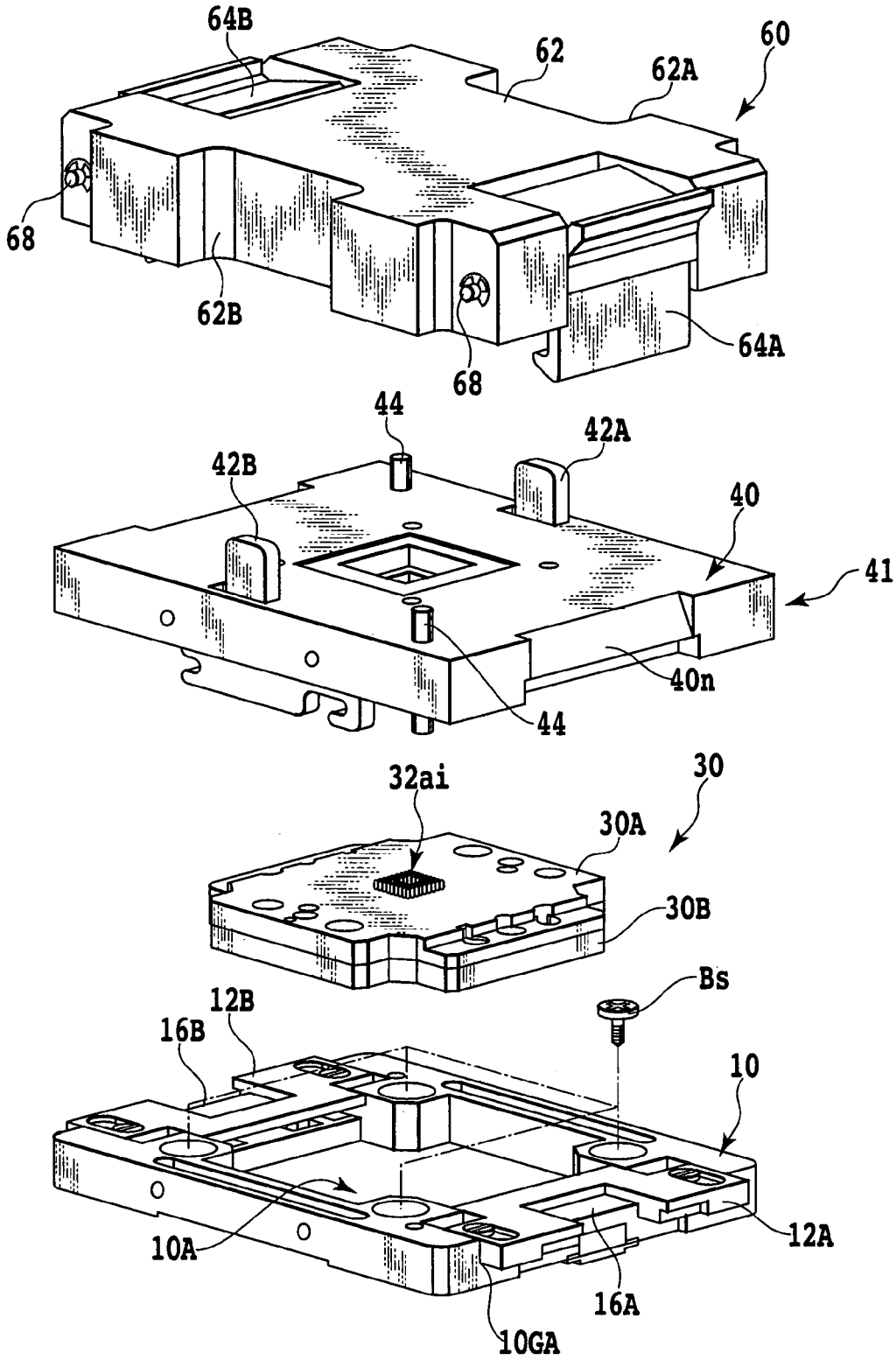
FIG. 5 is an exploded perspective view illustrating structural elements of the embodiment of a socket for a semiconductor device according to the present invention.
Figure 11:
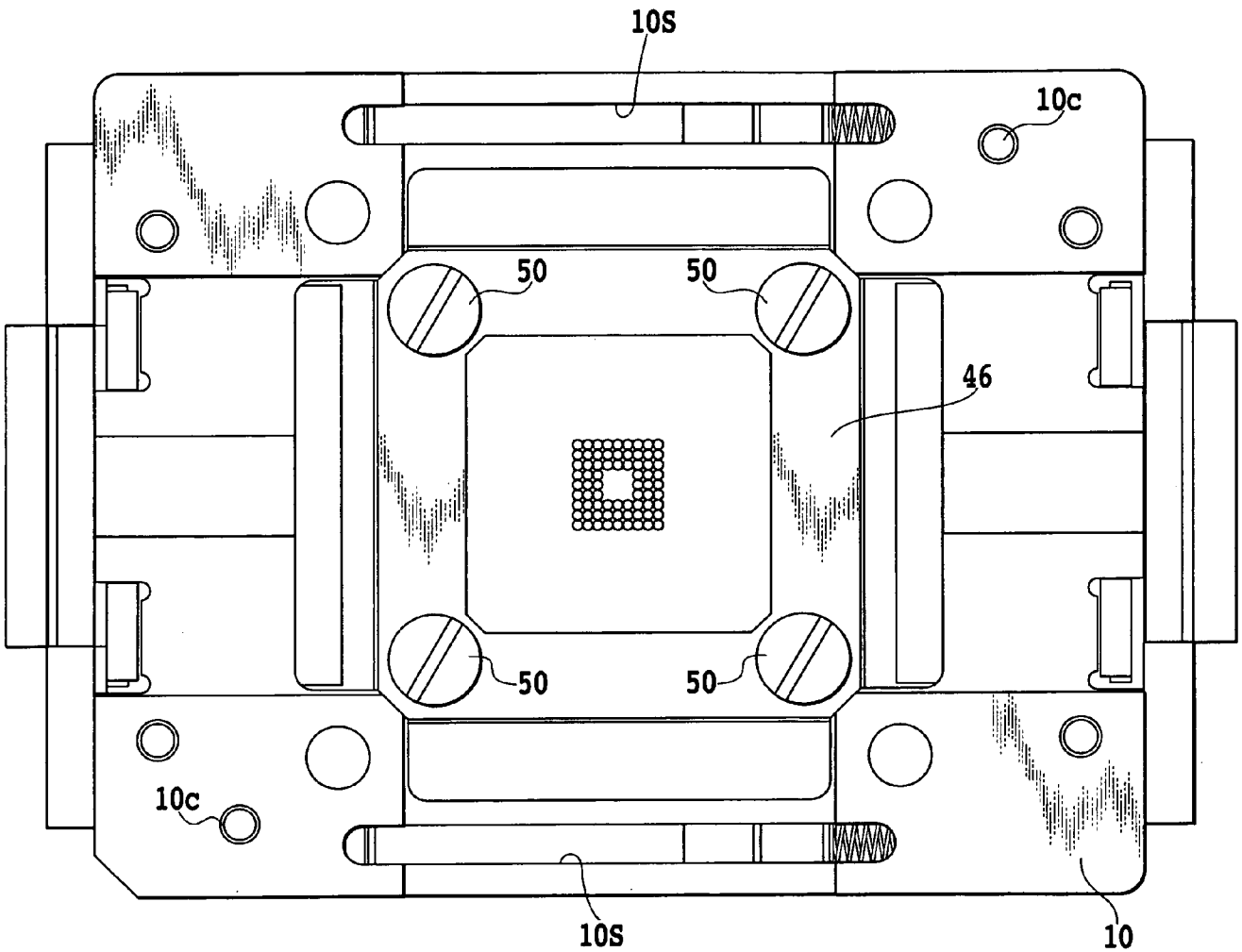
FIG. 11 is a bottom view showing a bottom surface of the frame body together with a positioning member, used in the socket for the semiconductor device according to the present invention.

As shown in FIG. 5, beneath the lid portion 60, the positioning pedestal unit 41 is arranged as means for mounting a semiconductor device. The positioning pedestal unit 41 having an outer dimension somewhat smaller than that of the lid portion 60 mainly includes a body portion 40 disposed between the lid portion 60 and the frame body 10, a positioning member 46 (see FIG. 11) disposed in a recess 40*a* formed in a central area of the body portion 40, and the lever members 42A and 42B movably disposed within slits 40R formed while interposing the recess 40*a* between the both at an end the long side of the body portion 40, respectively.

Figure 17:
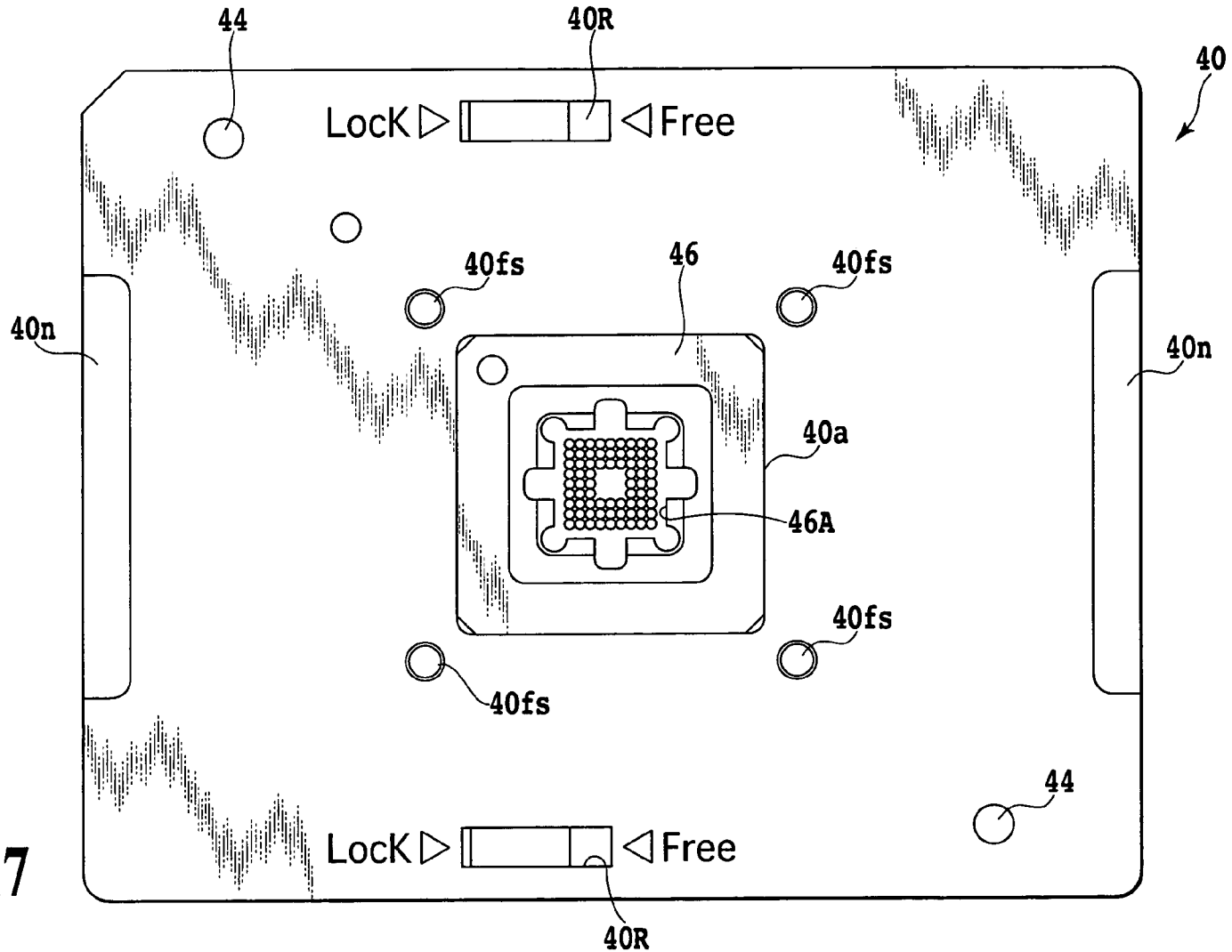
FIG. 17 is a plan view a positioning pedestal unit used in the embodiment of the socket for the semiconductor device according to the present invention.
Figure 18:
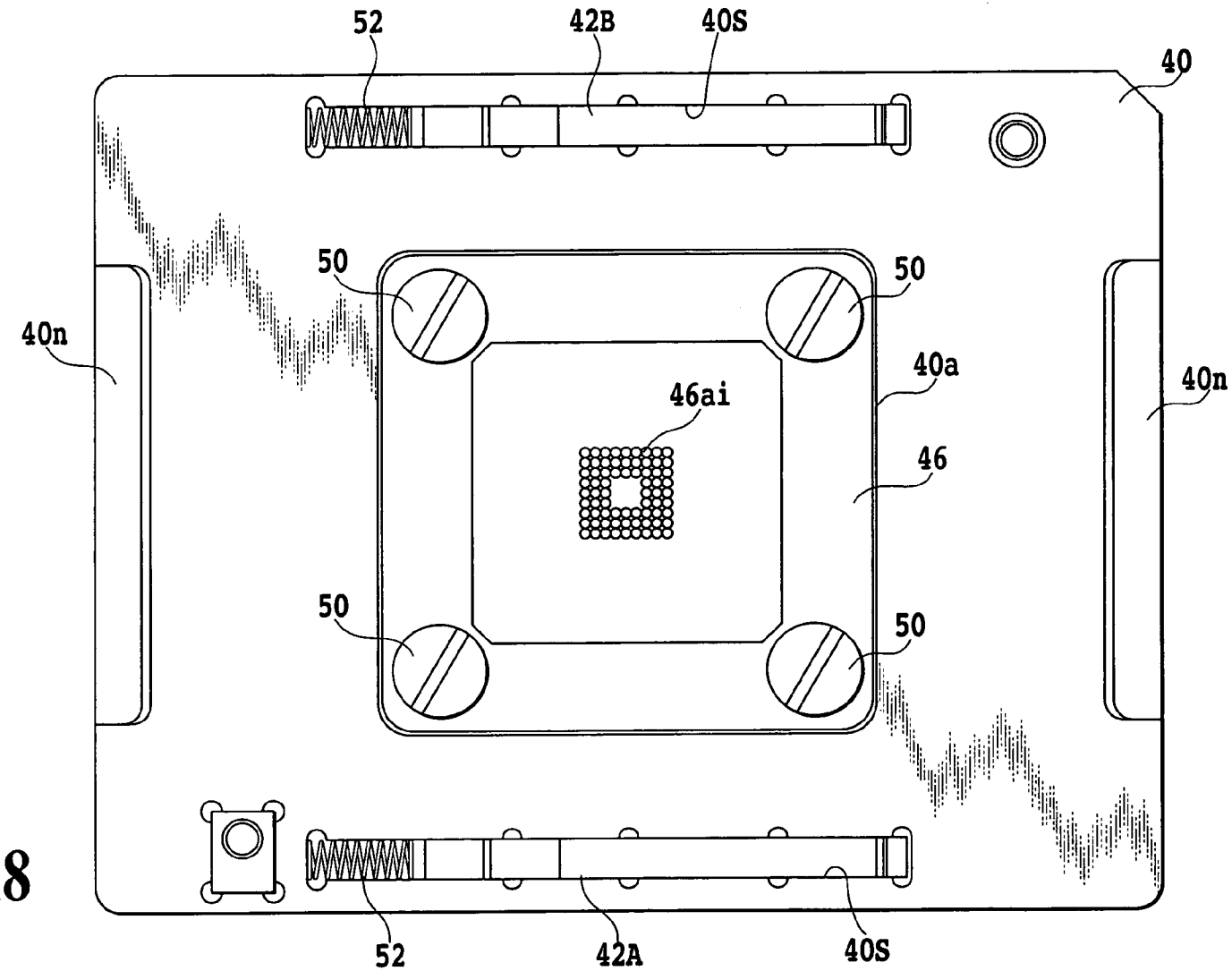
FIG. 18 is a bottom view of the embodiment shown in FIG. 17.
Figure 20:
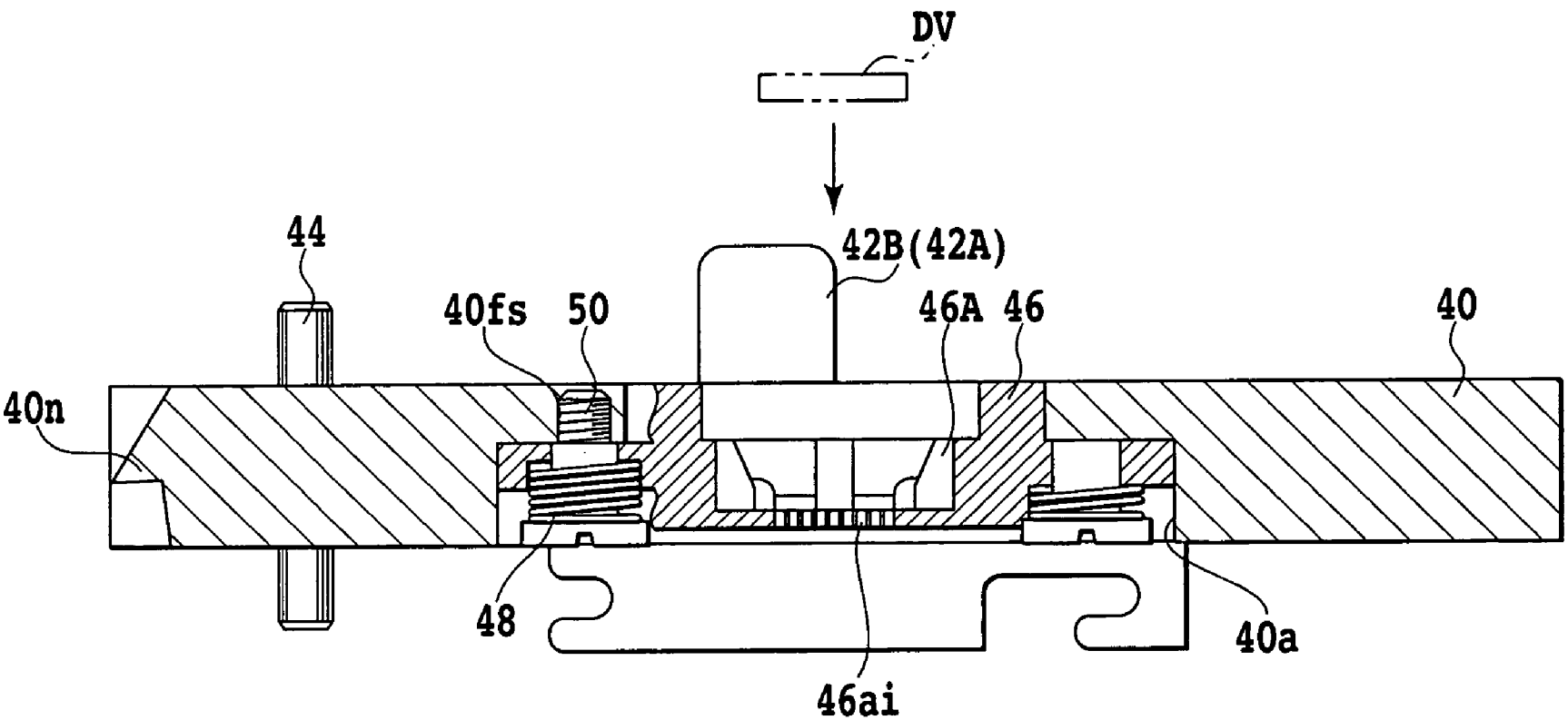
FIG. 20 is a sectional view of the embodiment shown in FIG. 17.

Nibs 40*n* to which are selectively engageable the projections of the above-mentioned latch members 64A and 64B are formed at opposite ends of the body portion 40 on shorter sides of the body portion 40. As shown in FIGS. 17, 18 and 20, the recess 40*a* is formed in the central area of the body portion 40 while passing through the same in the thickness direction. An upper portion of the recess 40*a* opens upward to define a smaller hole of a generally square shape, while a lower portion of the recess 40*a* opens downward to define a larger hole of a generally square shape relative to the former. At four positions in the vicinity of the periphery of the smaller hole of the recess 40*a* corresponding to the respective angles of the hole, there are female screw holes 40*fs* to be threaded with attachment screws 50 for fixing the positioning member 46 within the recess 40*a*.

The positioning member 46 has a semiconductor device accommodation area 46A at a center thereof. In the semiconductor device accommodation area 46A, the above-mentioned semiconductor device DV is placed while being positioned relative to a group of through-holes 46*ai* into which are inserted tip ends of a plurality of probe pins described later. The group of through-holes 46*ai* are formed on the bottom of the semiconductor device accommodation area 46A in a matrix manner. The positioning member 46 is held to be movable upward and downward relative to the body portion 40 at a relatively small stroke by inserting the attachment screws 50 into holes provided at the respective corners of the positioning member 40 and then being screw-engaged with the above-mentioned female screw holes 40*fs*. On the outer periphery of the respective attachment screw 50, a coil spring 48 is wound to bias the positioning member 46 toward the body portion 40 (see FIG. 20).

Figure 19:
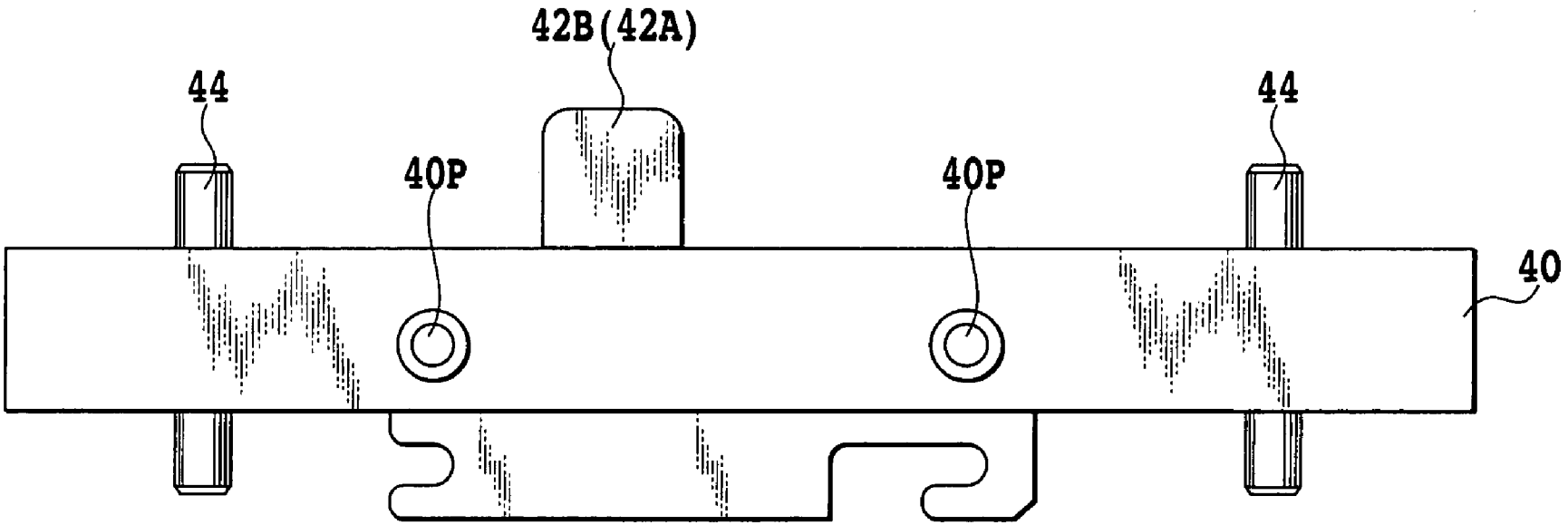
FIG. 19 is a front view of the embodiment shown in FIG. 17.

On the periphery of the positioning member 46, positioning pins 44 are provided in correspondence to the above-mentioned holes 62*c* of the lid portion 60. As shown in FIGS. 19 and 20, the positioning pins 44 vertically pass through a surface of the body portion 40, on which the lid portion 60 is placed (hereinafter referred to as the upper surface), in the thickness direction.

Since the lever members 42A and 42B movably disposed within the slits 40R have the same structure, the explanation thereof will be done solely on the lever member 42B and that on the lever member 42A will be eliminated.

Figure 21A:
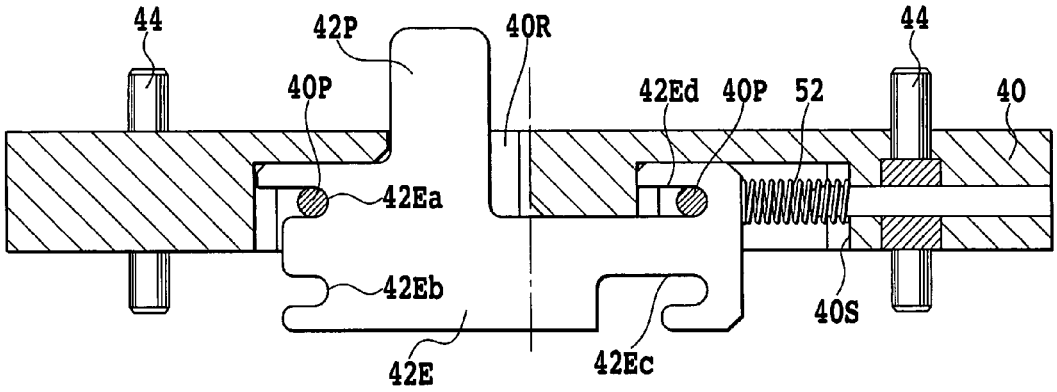
FIGS. 21A, 21B and 21C are partially sectional views, respectively, made available for explaining the operations of the embodiment shown in FIG. 17.

The slit 40R opening on the upper surface of the body portion 40 is formed generally parallel to the longer side thereof, and as shown in FIG. 21A in an enlarged manner, communicates with the interior of a recess 40S opening on the lower surface of the body portion 40. The interior of the recess 40S is sectioned into two parts by a partitioning wall and the respective part is provided with a guide pin 40P. The guide pin 40P is generally parallel to a short side of the body portion 40.

To the respective guide pin 40P, a guide groove 42Ea or 42Ed described later of the lever member 42B is engaged.

The lever member 42B, as enlargedly shown in FIG. 21A, includes the operation handle 42P projected outward via the slit 40R and a connecting portion 42E coupled to the operation handle 42P and disposed to be movable astride the two parts in the recess 40S. One end of the operation handle 42P is integral with the connecting portion 42E to extend generally in the direction vertical to the connecting portion 42E. At opposite ends of the connecting portion 42E, the guide grooves 42Ea and 42Ed, and the locking grooves 42Eb and 42Ec are formed, respectively. The guide grooves 42Ea and 42Ed are formed away from each other on a common straight line. The locking grooves 42Eb and 42Ec are formed away from each other on a common straight line defined beneath the guide grooves 42Ea and 42Ed. The guide grooves 42Ea, 42Ed and the locking grooves 42Eb, 42Ec are formed generally parallel to the upper surface of the body portion 40, in other words, in the moving direction of the lever member 42B. In FIG. 21A, left ends of the guide grooves 42Ea, 42Ed and the locking grooves 42Eb, 42Ec are cut away. As enlargedly shown in FIGS. 21B and 21C, connecting pins 10*k* of the frame body 10 described later are selectively engageable to the locking grooves 42Eb and 42Ec.

A coil spring 52 is disposed between one end of the lever member 42B and the inner wall surface forming the recess 40S. One end of the coil spring 52 abuts to the one end of the lever member 42B. The other end of the coil spring 52 is held by a spring receiver provided on the inner wall surface forming the recess 40S. Thereby, the coil spring 52 biases the lever member 42B so that the guide grooves 42Ea and 42Ed are engaged with the guide pins 40P. Accordingly, when the operating handle 42P is actuated against the biasing force of the coil spring 52 in the direction shown by an arrow in FIG. 21B, the operating handle 42P is movable until the end surface thereof abuts to the inner surface of the slit 40R. At that time, the guide grooves 42Ea and 42Ed are always engaged with the guide pins 40P.

Figure 21B:
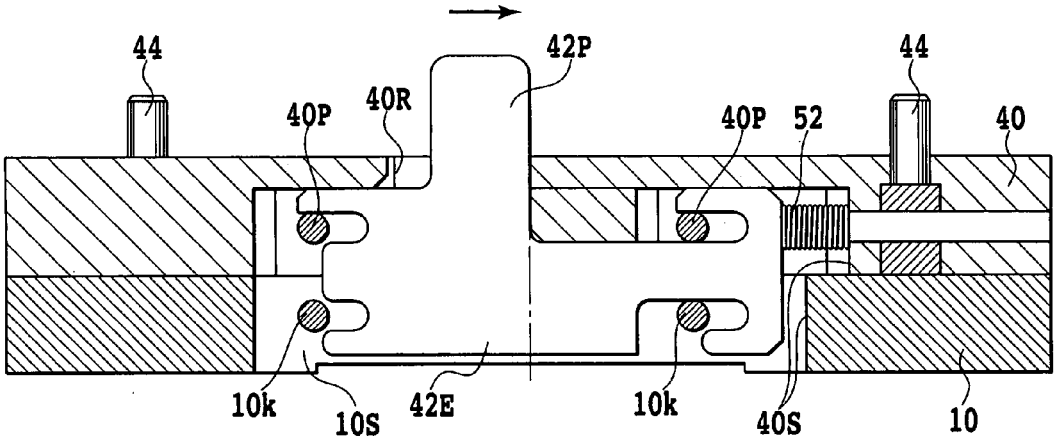
Figure 21C:
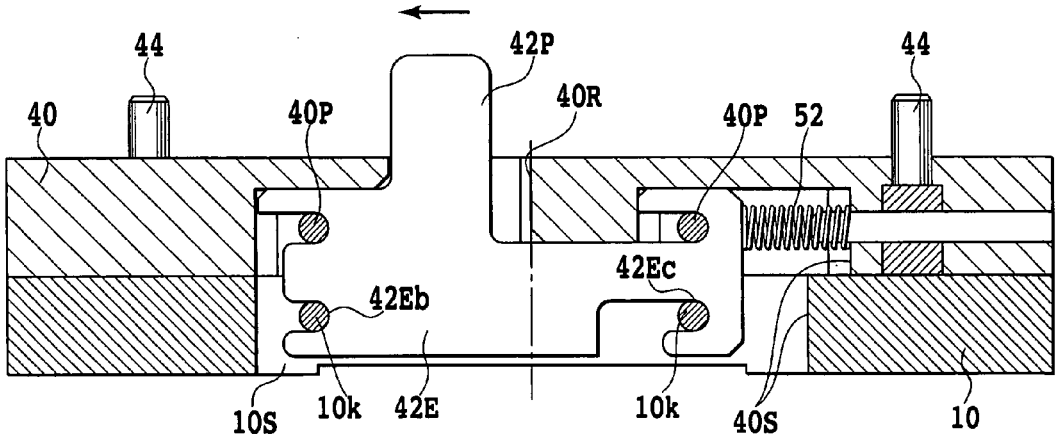

When the positioning pedestal unit 41 is coupled to the frame body 10, the respective operating handles 42P of the lever members 42A and 42B are first actuated in the direction shown by an arrow in FIG. 21B against the biasing force of the coil springs 52. Then, the connectors 42E of the lever members 42A and 42B are inserted into the slits 10S of the frame body 10, after which the positioning pedestal unit 41 is placed on the upper surface of the frame body 10. Subsequently, when the respective operating handles 42P of the lever members 42A and 42B are released, the lever members 42A and 42B are moved by the biasing force of the coil springs 52 in the direction shown by an arrow in FIG. 21C. Thereby, the locking grooves 42Eb and 42Ec are engaged with the connecting pins 10*k*, respectively, and thus the positioning pedestal unit 41 is coupled to the frame body 10 while being placed on the upper surface thereof.

In a central area of the frame body having approximately the same outer dimension as that the positioning pedestal unit 41, a cartridge accommodating region 10A is formed for detachably mounting a probe pin cartridge 30.

Figure 4:
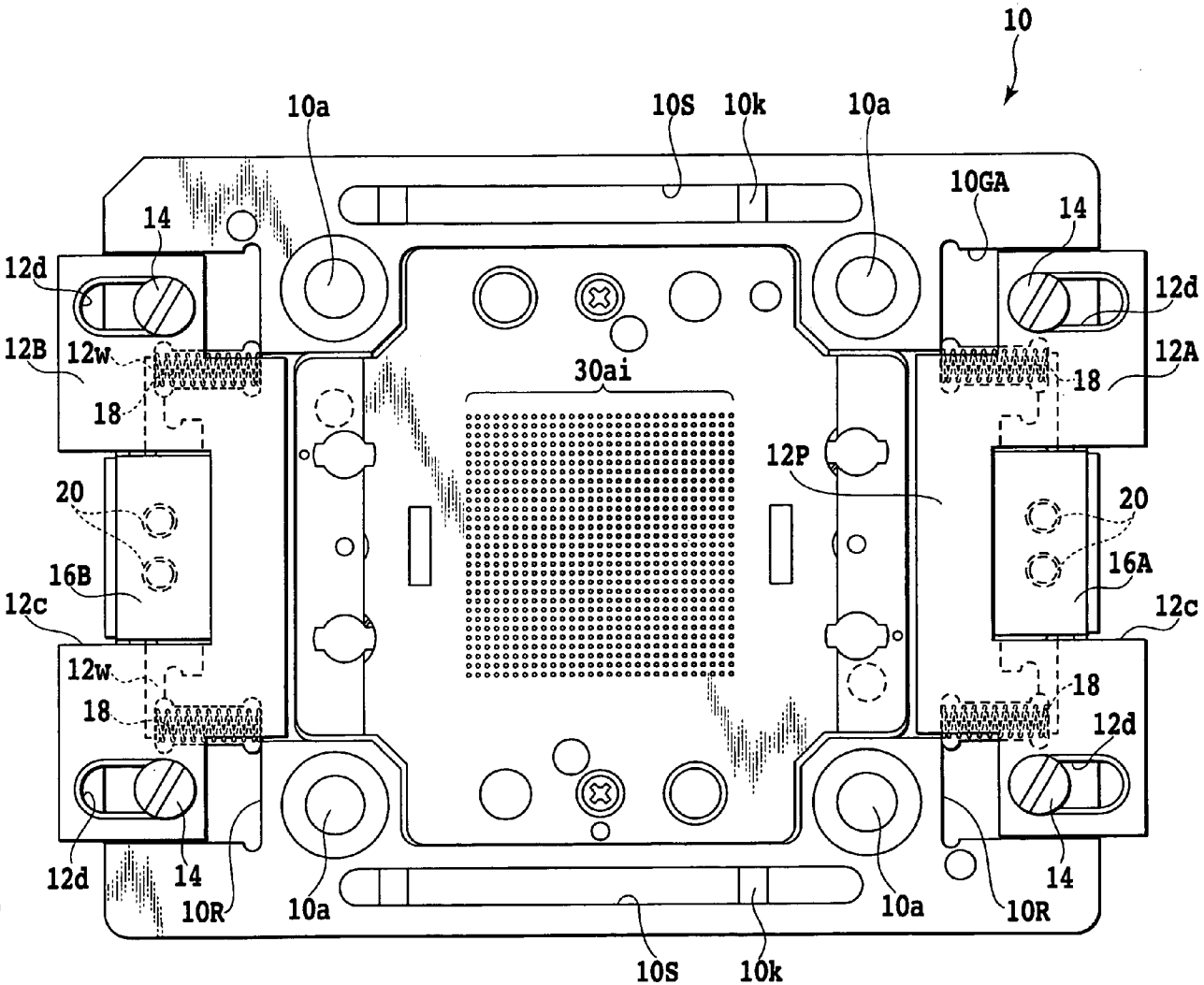
FIG. 4 is a plan view of the embodiment shown in FIG. 3.

The probe pin cartridge 30 has the same structure as that of a probe pin cartridge described, for example, in the specification of Japanese Patent Application No. 2005-067660 formerly filed by the inventors of the present invention. As shown in FIGS. 4, 5 and 8, the probe pin cartridge 30 mainly includes a cross-shaped substrate 30A disposed opposite to the positioning member 46, a substrate 30B having the same outer shape as that of the substrate 30A and placed directly beneath the substrate 30A, and a plurality of probe pins 32*ai* held by the substrates 30A and 30B.

The probe pin 32*ai* includes a contact having an arcuate tip end and electrically connected to the printed wiring board 2, a contact having a number of micro-projections at a tip end in the circumferential direction and electrically connected to an electrode of the semiconductor device DV, a sleeve movably accommodating proximal ends of both the contacts, and a coil spring (not shown) disposed between the proximal ends of both the contacts in the sleeve, for biasing the proximal ends of both the contacts away from each other.

The probe pins 32*ai* are arranged in correspondence to the arrangement of the electrodes of the semiconductor device DV, and the number of the probe pins is limited, for example, not to exceed approximately 200. A total length of the probe pin 32*ai* is, for example, approximately 4.8 mm or 5.7 mm.

Through-holes 30*ai* through which pass the respective probe pins 32*ai*, respectively, are formed in the respective substrates 30A and 30B in correspondence to the probe pins 32*ai*.

Figure 22:
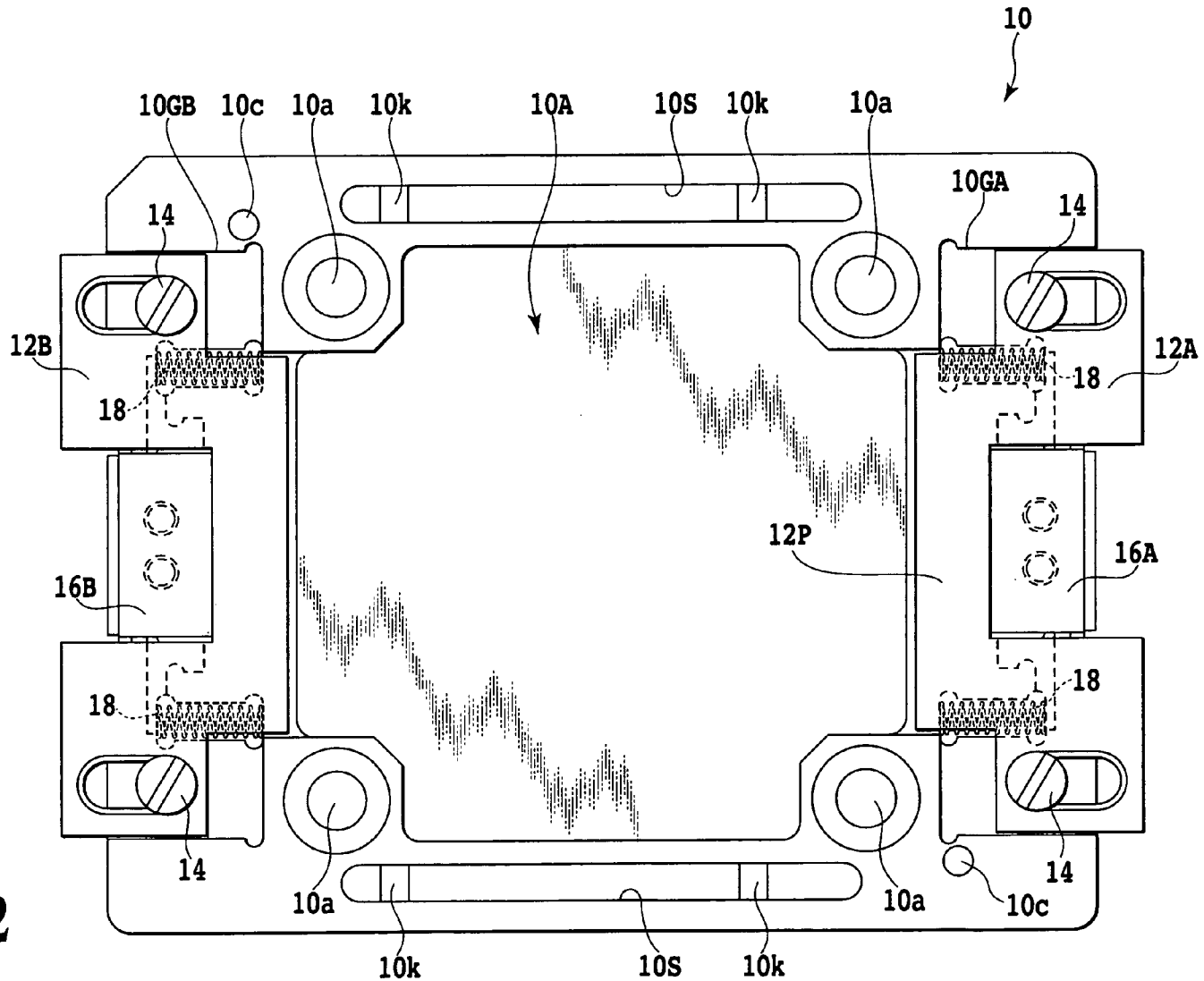
FIG. 22 is a plan view of a frame body used in the embodiment of the socket for the semiconductor device according to the present invention.

As shown in FIG. 22, on the periphery of the cartridge accommodating region 10A, holes 10*a* into which are inserted fastening screws Bs are formed at four corners thereof. The cartridge accommodating region 10A is formed to have a cross shape in correspondence to the contour of the above-mentioned substrate 30A. Thereby, the frame body 10 is fixed to the printed wiring board 2 by inserting the screws Bs into the holes 10*a* and the through-holes of the printed wiring board 2 and fastening the screws by nuts or the like.

On the periphery of one pair of the holes 10*a* located on one diagonal line of the frame body 10, positioning holes 10*c* are formed, respectively, into which are fit one ends of positioning pins 44 of the above-mentioned positioning pedestal unit 41.

Figure 26:
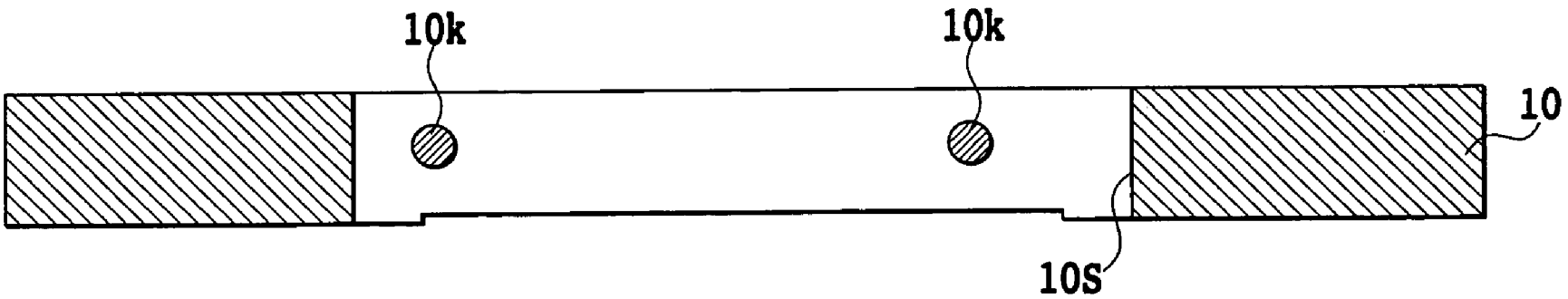
FIG. 26 is a partially sectional view of the embodiment shown in FIG. 22.

Along the respective longer side of the frame body 10, the slit 10S into which is inserted the lever member 42A, 42B of the above-mentioned positioning pedestal unit 41 is formed generally parallel to the longer side. In the respective slit 10S, as shown in FIG. 26, connecting pins 10*k* are provided away from each other at a distance. The connecting pins 10*k* are provided generally parallel to the shorter side of the frame body 10.

Figure 27:
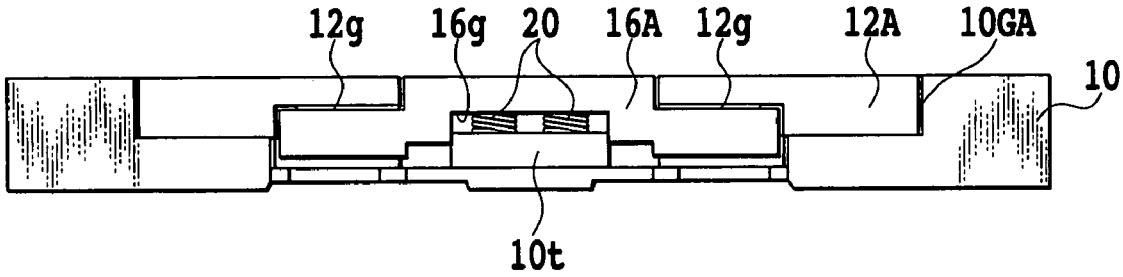
FIG. 27 is a side view of the embodiment in a state shown in FIG. 25.

As shown in FIGS. 22 and 27, on the shorter side of the frame body 10, a guide groove 10GA, 10GB in which the slider member 12A, 12B is slidable is formed. As shown in FIG. 4, the guide groove 10GA, 10GB is formed to be a generally T-shape and consists of a first groove portion contiguous to the cartridge accommodating region 10A and receiving a pressing piece 12P described later of the slider member 12A, 12B, and a second groove portion contiguous to the first groove portion and receiving a proximal end of the slider member 12A, 12B. The second groove portion is enlarged from the end of the first groove portion whereby a width of the second groove portion is larger than that of the first groove portion.

Since the slider members 12A and 12B have the same structure each other, the description will be done on the slider member 12A and the explanation of the slider member 12B will be eliminated.

Figure 1:
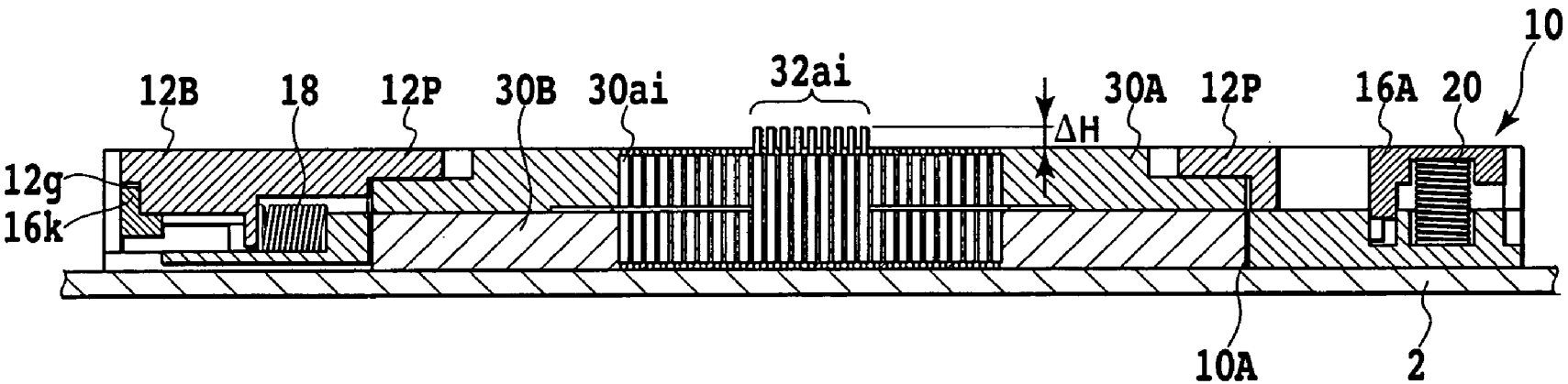
FIG. 1 is a sectional view of a frame body used in one embodiment of a socket for a semiconductor device according to the present invention, illustrating a important part thereof.
Figure 2:
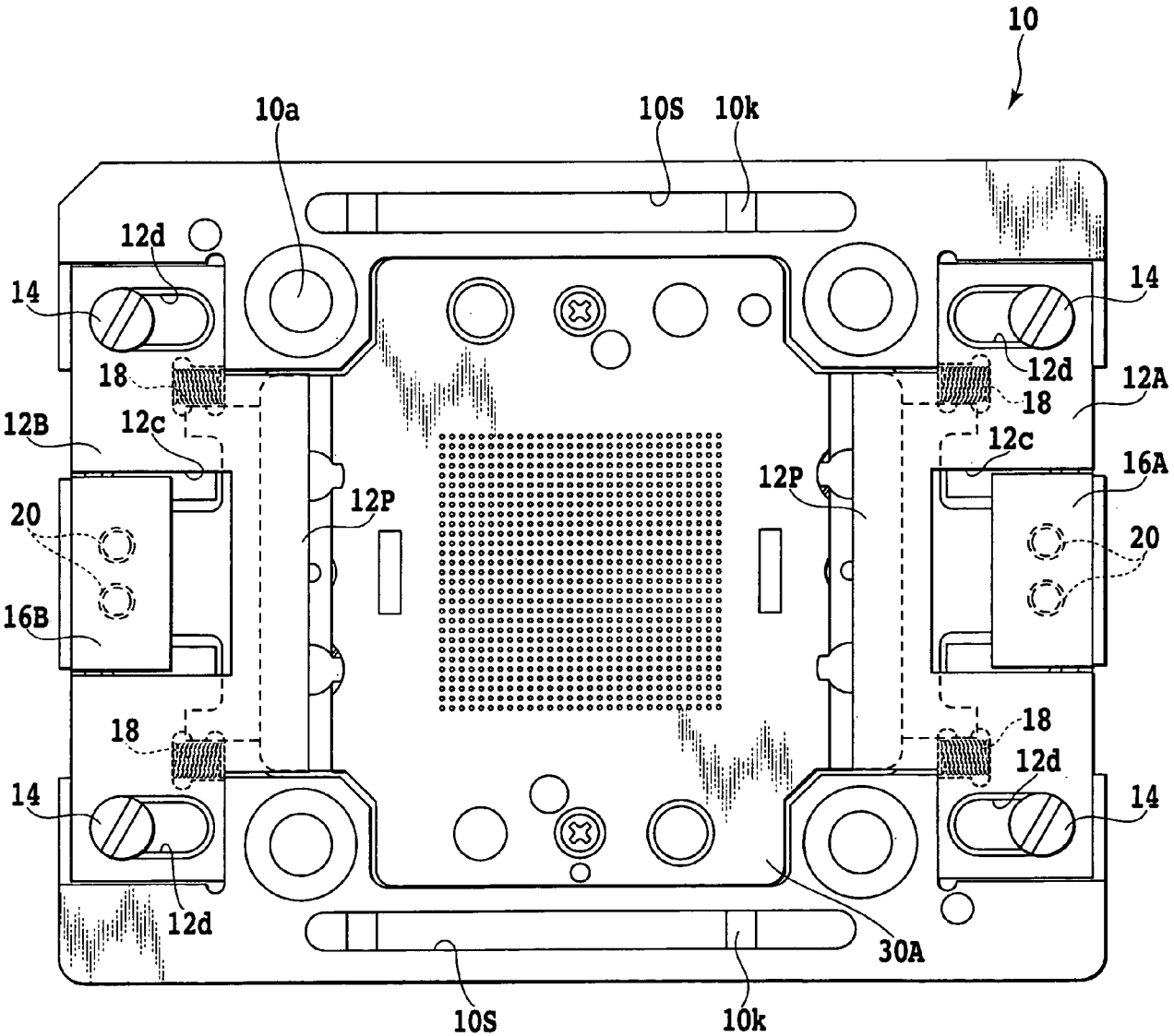
FIG. 2 is a plan view of the embodiment shown in FIG. 1.

As shown in FIG. 2, the slider member 12A of a crank shape includes a proximal end having a notch 12*c* of a rectangular shape and a pressing piece 12P formed integral with the proximal end. The pressing piece 12P for selectively pressing and holding the substrate 30A of the mounted probe pin cartridge 30 is movably engaged with the first groove portion in the above-mentioned guide groove 10GA. The proximal end thereof is movably engaged with the second groove portion in the above-mentioned guide groove 10GA. At a center of the proximal end, the notch 12*c* in which an operating button 16A is disposed is formed. Between an end 10R of the guide groove 10GA and the end surface of the proximal end of the slider member 12A, a pair of coil springs 18 are provided as shown in FIGS. 2 and 4. As shown in FIG. 4, the coil springs 18 bias the slider member 12A away from the cartridge accommodating region 10A. One end of the coil spring 18 touches to a projecting piece 12*w* of the slider member 12A as shown in FIG. 1, and the other end of the coil spring 18 touches to the end 10R of the guide groove 10GA. At opposite ends of the proximal end of the slider member 12A across the notch 12*c*, elongated holes 12*d* are formed, respectively. In the elongated hole 12*d*, a stopper pin 14 for restricting a moving amount of the slider member 12A is inserted. One end of the stopper pin 14 is fixed to the frame body 10. Accordingly, as shown in FIG. 4, when part of the slider member 12A goes outward by the biasing force of the coil spring 18, the peripheral edge of the elongated hole 12*d* is engaged with the outer circumference of a flange of the stopper pin 14 to limit the movement of the slider member 12A. On the other hand, if a tip end of the slider member 12A is made to move against the biasing force of the coil spring 18 toward the cartridge accommodating region 10A, the end surface of the proximal end touches to the end 10R of the guide groove 10GA, whereby the movement thereof is limited.

Figure 23:
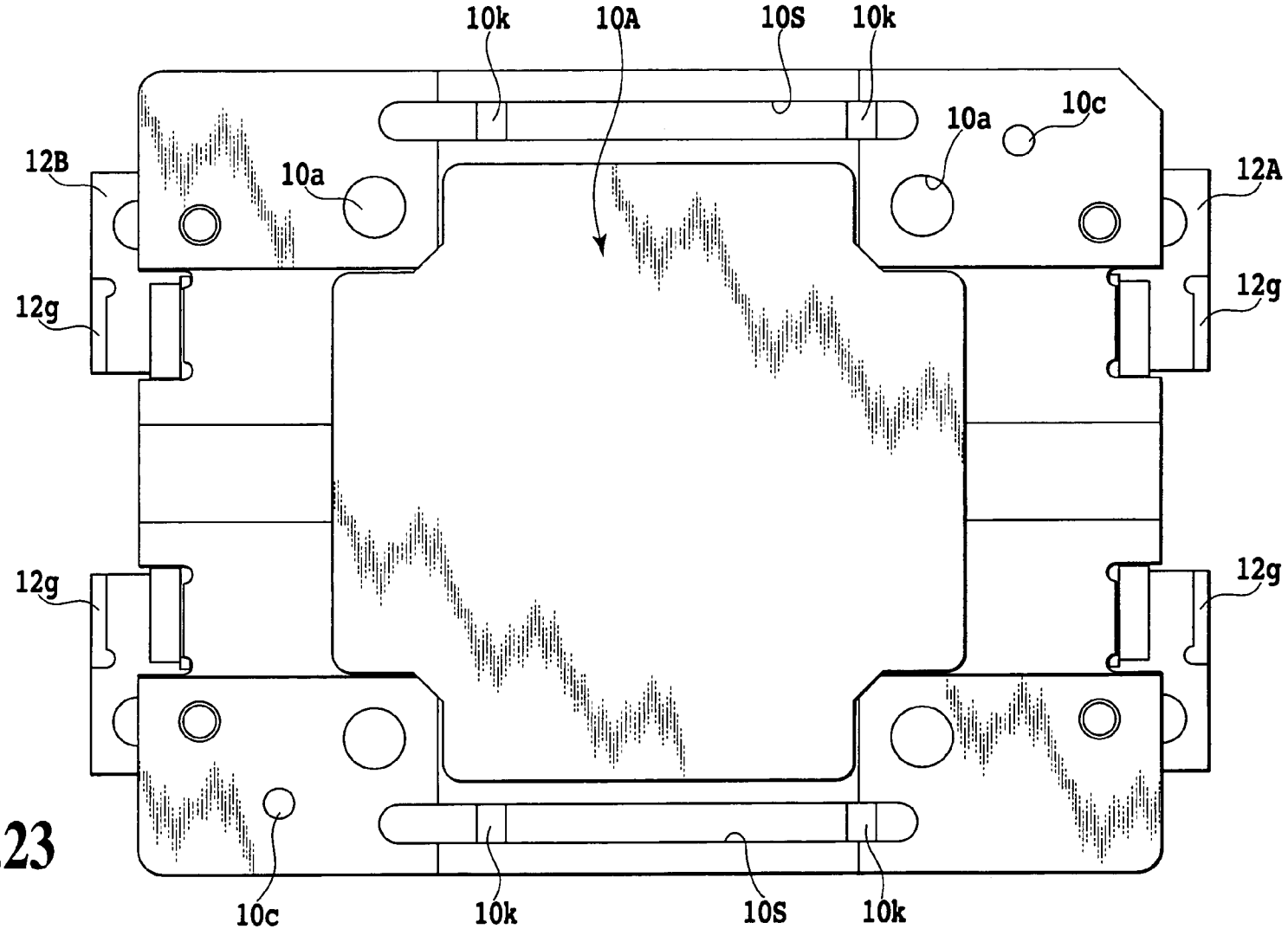
FIG. 23 is a bottom view of the embodiment shown in FIG. 22.

As shown in FIG. 23, at an end of the lower surface of the slider member 12A, grooves 12*g* to be engageable with a pair of projections of the operating buttons 16A described later are formed.

The operating buttons 16A and 16B are disposed in the cutoffs 12*c* of the slider members 12A and 12B to be movable upward and downward. Since the operating buttons 16A and 16B have the same structure, the description will be made on the operating button 16A and the explanation of the operating button 16B will be eliminated.

Figure 24:
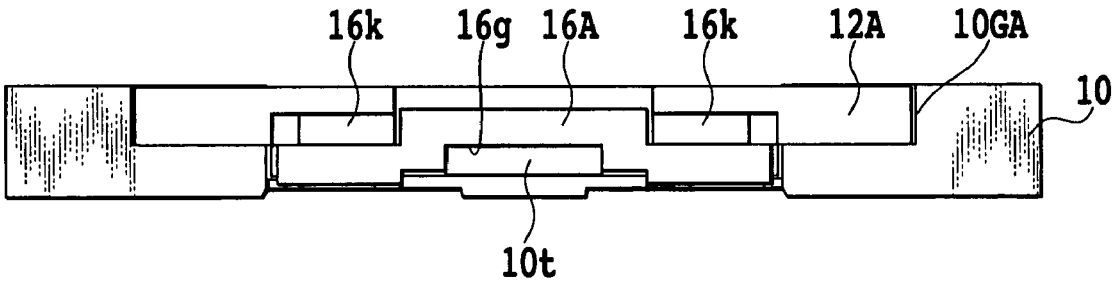
FIG. 24 is a side view of the embodiment shown in FIG. 22.
Figure 25:
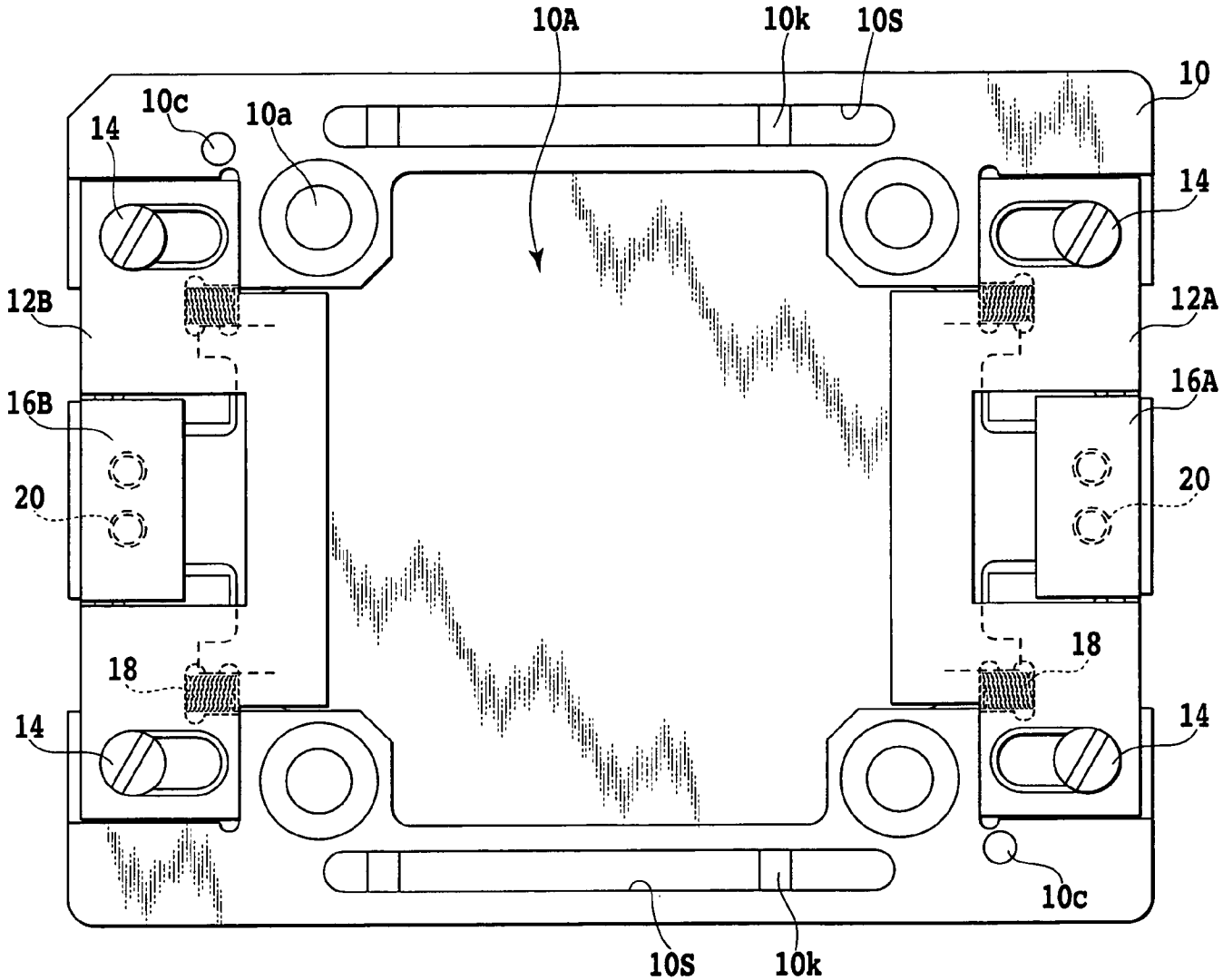
FIG. 25 is a plan view made available for explaining the operation of the embodiment shown in FIG. 22.

As shown in FIGS. 24 and 27, the operating button 16A has a groove 16*g* at a center of the lower end thereof, engageable with a projection 10*t* formed on the bottom of the guide groove 10GA of the frame body 10. Thereby, the posture of the operating button 16A in the direction vertical to the moving direction of the slider member 12A is restricted.

On opposite sides of the groove 16*g*, there are overhangs having the projections 16*k* engageable with the groove 12*g* of the slider member 12A. Also, as shown enlargedly in FIGS. 1 and 3, the operating button 16A has a bending portion inserted into a recess formed on the bottom of the guide groove 10A at an end on the side of the cartridge accommodating region 10A. Thereby, the smooth upward and downward movement of the operating button 16A takes place as the bending portion is guided by the recess. Further, a coil spring 20 is provided between the hole with bottom of the operating button 16A and that of the frame body 10. The coil spring 20 biases the projection 16*k* of the operating button 16A in the direction for engaging the projection with the groove 12*g* of the slider member 12A. At that time, the topmost end surface of the operating button 16A, the upper surface of the slider member 12A and the upper surface of the frame body 10 are located in a common plane.

Thereby, when the slider members 12A and 12B are moved closer to each other against the biasing force of the coil spring 18, the projection 16*k* of the operating button 16A is automatically engaged with the groove 12*g* of the slider member 12A by the biasing force of the coil spring 20. That is, the slider members 12A and 12B are locked to the frame body 10 so that the mounted probe pin cartridge 30 is held in the cartridge accommodating region 10A.

Accordingly, the lock/unlock mechanism is formed of the slider members 12A and 12B, the operating buttons 16A and 16B and the coil springs 18 and 20.

In this structure, when the semiconductor device is tested, the lid portion 60 is first removed from the positioning pedestal unit 41 disposed on the upper surface of the frame body 10, and the semiconductor device DV is mounted to the semiconductor accommodating region 46A of the positioning member 46. Then, as shown in FIG. 8, the predetermined test is carried out under the condition wherein the lid portion 60 is held onto the positioning pedestal unit 41 so that the semiconductor device DV is pressed onto the contacts of the probe pins 32*ai*.

Figure 3:
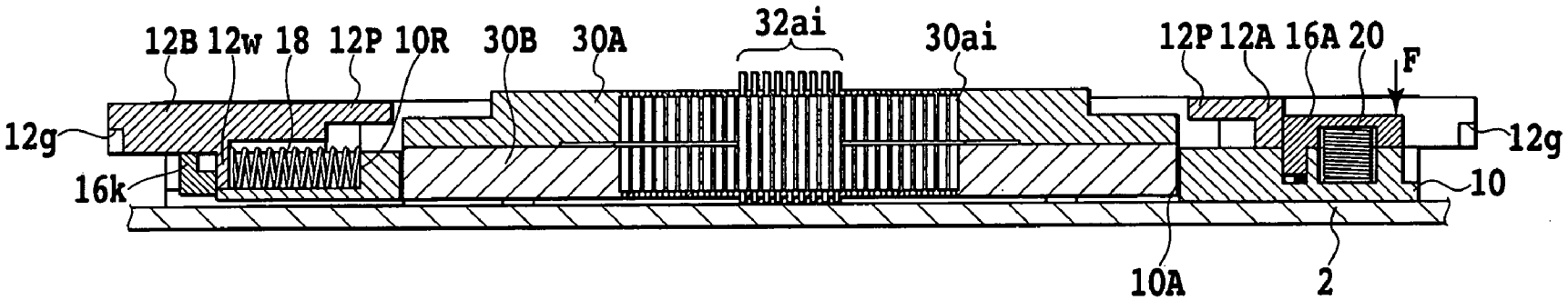
FIG. 3 is a sectional view made available for explaining the operation of the embodiment shown in FIG. 1.

Upon the exchange of the probe pin 32*a* or the probe pin cartridge 30 as a whole, as shown in FIG. 1, the lid portion 60 and the positioning pedestal unit 41 are removed from the frame body. Thereafter, as shown in FIGS. 3 and 4, a predetermined force F is applied in the direction shown by an arrow to the operating buttons 16A and 16B against the biasing force of the two coil springs 20. Thus, the projections 16*k* of the operating buttons 16A and 16B are disengaged from the grooves 12*g* of the slider members 12A and 12B, whereby the slider members 12A and 12B is in an unlocked state.

Figure 10:
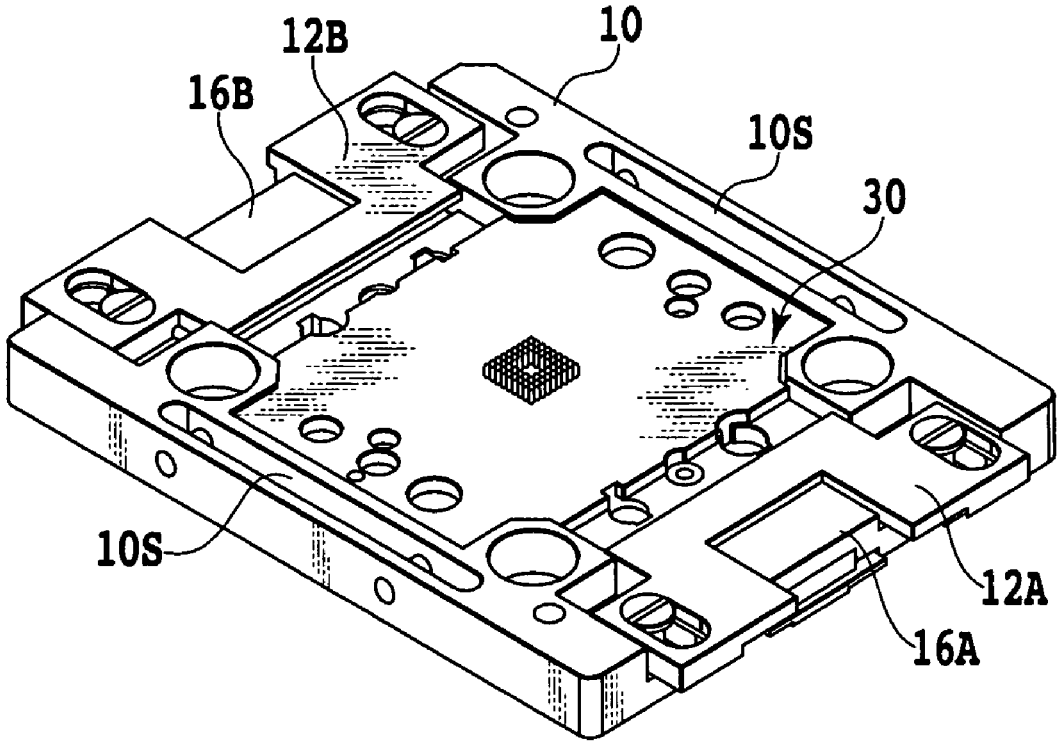
FIG. 10 is a perspective view showing the frame body and a probe pin cartridge in a state shown in FIG. 4.

As a result, as shown in FIG. 10, the slider members 12A and 12B are moved so that the proximal ends thereof are away from each other by the biasing force of the coil springs 18 and projected out of the outer circumferential surface of the frame body 10. Thereby, the used probe pin cartridge 30 is easily dismounted from the cartridge accommodating region 10A.

Figure 12:
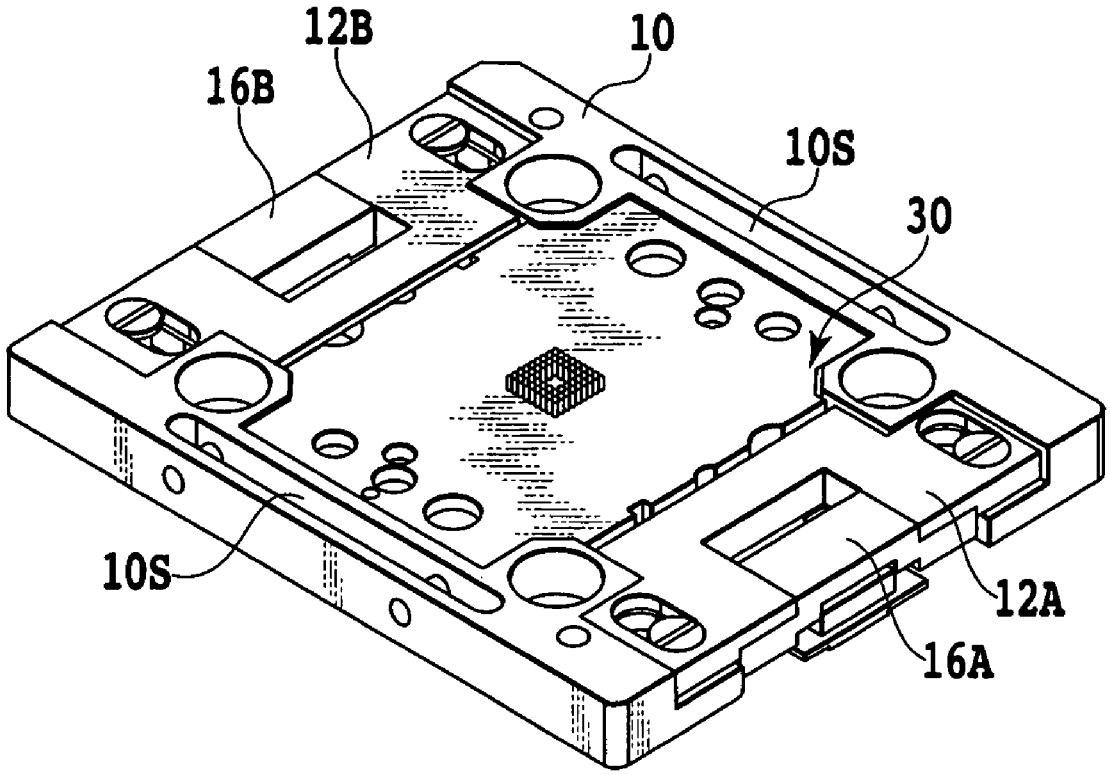
FIG. 12 is a perspective view showing the frame body and the probe pin cartridge in a state shown in FIG. 2.

On the other hand, when a fresh probe pin cartridge 30 is newly mounted to the cartridge accommodating region, the probe pin cartridge 30 is first inserted into the cartridge accommodating region 10A, then pressed at a constant pressure against the repulsive force of the probe pins 32*ai* in the direction wherein the slider members 12A and 12B are close to each other. Thereby, the sliders 12A and 12B are in the locked state because the projections 16*k* are automatically engaged with the grooves 12*g* of the slider members 12A and 12B due to the biasing force of the coil springs 20. Thereby, as shown in FIG. 12, the substrate 30A of the probe pin cartridge 30 is held by the pressing pieces 12P of the slider members 12A and 12B. At that time, as shown in FIG. 1, the tip end of the contact of the probe pin 32*ai* is located at a position higher by a predetermined height ΔH than the upper surface of the frame body 10, the substrate 30A, the slider members 12A and 12B. Thus, the replacement of the probe pin or the exchange of the probe pin cartridge as a whole has been completed.

Accordingly, the replacement of the probe pin 32*ai* or the exchange of the probe pin cartridge 30 as a whole could be carried out simply and quickly. Since the upper surfaces of the frame body 10, the slider members 12A and 12B, and the operating buttons 16A and 16B are in a flat plane common to each other, it is easy to place a positioning pedestal unit of other existing type on the frame body 10.

For example, when a known handler is used instead of the above-mentioned lid portion 60 and positioning pedestal unit 41 for the purpose of holding and pressing the semiconductor device, it is possible to approach the handler disclosed, for example, in Japanese Patent Laid-Open No. 10-073635 (1998) to the probe pin 32*ai* without the interference with other portions since the position of the tip end of the contact of the probe pin 32*ai* is higher by the predetermined value ΔH than the upper surface of the operating buttons 16A and 16B. Also, it is possible to set an ascending/descending amount of the handler as small as possible so that the test is efficiently carried out. At that time, the degree of freedom for designing a shape of the automatic handler increases, in comparison with a case wherein the position of the tip end of the contact of the probe pin 32*ai* is lower than those of other components in the structure.

In addition, since the tip end of the contact of the probe pin 32*ai* is located at a position higher by the predetermined height value ΔH than those of the other components in the structure, the wear, deformation or contamination of the contact of the probe pin 32*ai* is easily visible. Thus, the cleaning operation of the contact of the probe pin 32*ai* becomes easy to remove dusts therefrom without any residue.

In the above-mentioned embodiment, while the present invention has been applied to the lid form socket of a manual type, the present invention should not be limited to such a socket but the positioning pedestal unit 41 and the frame body 10 may be applied to other type sockets such as a clam shell type, for example, disclosed in Japanese Patent Application No. 2005-067660 formerly filed by the inventors of the present invention.

While the present invention has described with reference to exemplary embodiments, it is to be understood that the invention is not limited to the disclosed embodiments. The scope of the following claims is to be accorded the broadest interpretation so as to encompass all such modifications and equivalent structures and functions.

What is claimed is:

1. A socket for a semiconductor device, comprising:

a contact terminal cartridge having a substrate for holding a group of contact terminals electrically connected to terminals of a semiconductor device;

a frame body fixed onto said substrate, having an accommodating region for detachably accommodating said contact terminal cartridge; and a locking/unlocking mechanism including slider members slidably disposed in said frame body, for holding said contact terminal cartridge accommodated in said accommodating region in a locked state or an unlocked state, wherein the upper surfaces of said slider members are located at a position lower than the topmost ends of contact terminals forming said group of contact terminals of said contact terminal cartridge.

2. A socket for a semiconductor device as claimed in claim 1, wherein said slider member has an elongated hole and a stopper pin is inserted in the elongated hole with one end of the stopper pin fixed to said frame body.

3. A socket for a semiconductor device as claimed in claim 1, wherein a semiconductor device mounting region wherein said semiconductor device is detachably mounted is removably disposed on the upper surface of said frame body.

4. A socket for a semiconductor device as claimed in claim 3, wherein said semiconductor device mounting region has movable lever members selectively locked with locking shafts provided on the periphery of said accommodating region of said frame body.

5. A socket for a semiconductor device as claimed in claim 3, wherein a pressing mechanism member is detachably arranged in said semiconductor device mounting region, said pressing mechanism member pressing terminals of said semiconductor device mounted to said semiconductor device mounting region onto contact terminals forming a group of contact terminals of said contact terminal cartridge.

6. A socket for a semiconductor device as claimed in claim 1, wherein said locking/unlocking mechanism comprises operating buttons for selectively holding said slider members relative to said frame body so that said slider members maintain said contact terminal cartridge in said locked state or said unlocked state; and a biasing member for biasing said slider member in one direction when said slider member is in said unlocked state.

7. A socket for a semiconductor device as claimed in claim 6, wherein said operating button has projections engageable with the groove formed in said slider member and an elastic member is provided between said operating button and said frame body, said elastic member for biasing the projections of the operating button in the direction for engaging the projection with the groove of said slider member.

* * * * *